US008666667B2

(12) United States Patent
Michael et al.

(10) Patent No.: US 8,666,667 B2
(45) Date of Patent: Mar. 4, 2014

(54) HYDROCARBON PRODUCTION ALLOCATION METHODS AND SYSTEMS

(75) Inventors: Gerald Eric Michael, Katy, TX (US); Olufemi Akande Jokanola, Richmond, TX (US)

(73) Assignee: ConocoPhillips Company, Houston, TX (US)

( * ) Notice: Subject to any disclaimer, the term of this patent is extended or adjusted under 35 U.S.C. 154(b) by 455 days.

(21) Appl. No.: 13/110,698

(22) Filed: May 18, 2011

(65) Prior Publication Data

US 2011/0297370 A1 Dec. 8, 2011

Related U.S. Application Data

(60) Provisional application No. 61/352,145, filed on Jun. 7, 2010.

(51) Int. Cl.

| | |
|---|---|
| ***G01V 1/40*** | (2006.01) |
| ***G01V 3/18*** | (2006.01) |
| ***G01V 5/04*** | (2006.01) |
| ***G01V 9/00*** | (2006.01) |
| *G01N 15/08* | (2006.01) |
| *G01N 31/00* | (2006.01) |
| *H01J 49/00* | (2006.01) |

(52) U.S. Cl.
USPC ..... 702/11; 702/9; 702/12; 702/13; 702/23; 250/281; 250/288

(58) Field of Classification Search
USPC ..... 702/9, 11–13, 23; 250/281, 288
See application file for complete search history.

(56) References Cited

U.S. PATENT DOCUMENTS

| | | | | |
|---|---|---|---|---|
| 4,517,461 | A | 5/1985 | Crandall | |
| 4,833,915 | A | 5/1989 | Radd et al. | |
| 5,012,052 | A | 4/1991 | Hayes | |
| 5,142,143 | A * | 8/1992 | Fite et al. | 250/288 |
| 5,286,651 | A | 2/1994 | Smith | |
| 6,176,323 | B1 * | 1/2001 | Weirich et al. | 175/40 |
| 6,290,000 | B1 * | 9/2001 | Zamfes | 175/50 |
| 6,331,436 | B1 | 12/2001 | Richardson et al. | |
| 7,124,030 | B2 | 10/2006 | Ellis | |
| 7,174,254 | B2 * | 2/2007 | Ellis | 702/9 |

(Continued)

OTHER PUBLICATIONS

Alan T. James, "Correlation of Natural Gas by Use of Carbon Isotopic Distribution Between Hydrocarbon Components", vol. 67, Jul. 1983, pp. 1176-1191.

(Continued)

*Primary Examiner* — Ramesh Patel
(74) *Attorney, Agent, or Firm* — ConocoPhillips Company

(57) ABSTRACT

Methods and systems are provided for allocating production among reservoir compartments by way of compositional and isotopic analysis. That is, where individual reservoir compartments contribute differing amounts of fluid to a commingled production stream, the methods herein determine the relative contribution of fluid volume from each reservoir compartment.

Both a composition-based relative contribution and an isotope-based relative contribution of fluid from each reservoir compartment may be determined to allocate production to each reservoir compartment, the determinations respectively being based on composition mass balances and stable carbon isotope mass balances of components. The combination of both allocation analysis provides quality checks on the results that identify improper allocations that may arise. In addition to production allocation, other applications include, among others, determining the effectiveness of intervention operations and providing feedback for adjusting operations. Advantages include lower costs, higher accuracies, and ease of use as compared to conventional methods.

21 Claims, 15 Drawing Sheets

(56) References Cited

U.S. PATENT DOCUMENTS

| | | | | |
|---|---|---|---|---|
| 7,529,626 | B1 * | 5/2009 | Ellis | 702/9 |
| 7,881,869 | B2 * | 2/2011 | Clayton et al. | 702/18 |
| 7,939,335 | B1 * | 5/2011 | Triche et al. | 436/139 |
| 7,976,780 | B2 * | 7/2011 | Elrod et al. | 422/78 |
| 7,985,597 | B2 * | 7/2011 | Huber et al. | 436/181 |
| 2006/0097144 | A1 * | 5/2006 | Kingston et al. | 250/282 |
| 2007/0054402 | A1 * | 3/2007 | Jasper | 436/56 |
| 2008/0147326 | A1 * | 6/2008 | Ellis | 702/9 |
| 2013/0037707 | A1 * | 2/2013 | Lamberti et al. | 250/282 |

OTHER PUBLICATIONS

Ulrich Berner and Eckhard Faber, "Maturity Related Mixing Model for Methane, Ethane and Propane, Based on Carbon Isotopes", Org. Geochem., vol. 13, 1988, pp. 67-72.

Herwig Ganz, Martini Akande Dolapo, Vincent Okpoto, Colin Davidson, Ray Berhitoe and Rob Kruelen, "Geochernical Fingerprinting Technology in SPDC: Improving Reservoir Models and Field Development", SPE 88884, 6 pages, Aug. 2004.

Herwig Ganz, Vincent Okpoto, Seye Ososanya, Isaac Olabimtan, Elijah Ukpabio, Ray Berhitoe, Rob Kruelen and Bart van den Haven, "Geochemical Fingerprinting in Multi-Stacked Deltaic Reservoirs—Opportunities and Challenges", AAPG International Conference, 2008, Abstract Only, 1 page.

Xianquing Li, Xianming Xiao, Yongchun Tang, Hui Tian, Qiang Zhou, Yunfeng Yang, Peng Dong, Yan Wang and Zhihong Song, "The Modeling of Carbon Isotope Kinetics and Its Application to the Evaluation of Natural Gas", Front Earth Science China, 2008, pp. 96-104.

"NFQ8-1 Well Geochemistry, North Field, Qatar", Prepared by ConocoPhillips for Qatargas 3&4 Project, Home Office Service Request HOS-0233-C-DRL, 2008, 16 pages.

Elin Rein, Linda Kristin Schulz, "Applications of Natural Gas Tracers in the Detection of Reservoir Compartmentalisation and Production Monitoring", Journal of Petroleum Science & Engineering, 2007, pp. 428-442.

Martin Schoell, "Genetic Characterization of Natural Gas", The American Association of Petroleum Geologists Bulletin, vol. 67, Dec. 1983, pp. 2225-2238.

Martin Schoell and P.D. Jenden, "Isotope Analyses of Gases in Gas Field and Gas Storage Operations", SPE 26171, 1993, pp. 337-344.

"Inventor Response", G. Eric Michael, Femi Jokanola, Apr. 16, 2010, Abstract Only, 1 page.

* cited by examiner

HYDROCARBON PRODUCTION ALLOCATION METHODS AND SYSTEMS

CROSS-REFERENCE TO RELATED APPLICATIONS

This application is a non-provisional application which claims the benefit of and priority to U.S. Provisional Application Ser. No. 61/352,145 filed Jun. 7, 2010, entitled "Hydrocarbon Production Allocation Methods and systems," which is hereby incorporated by reference in its entirety.

FIELD OF THE INVENTION

The present invention relates generally to methods and systems for allocating production among a plurality of reservoir compartments of a subterranean formation. More particularly, but not by way of limitation, embodiments of the present invention include methods and systems for allocating production among a plurality of reservoir compartments by way of compositional and isotopic analyses.

BACKGROUND

Hydrocarbon-bearing subterranean formations often contain a number of reservoir compartments physically isolated from one another. Wellbores are often drilled through the subterranean formations to produce hydrocarbons from a number of the reservoir compartments. FIG. 1 illustrates an example of such a system.

In particular, wellbore 110 is disposed through subterranean formation 120. Subterranean formation 120 comprises first reservoir compartment 131 and second reservoir compartment 132. First reservoir compartment 131 is geologically isolated from second reservoir compartment 132 by shale layers 130 such that first reservoir compartment 131 is not in fluid communication with second reservoir compartment 132. Nevertheless, casing 121 of wellbore 110 is perforated in each reservoir compartment 131 and 132 to allow fluid from both first reservoir compartment 131 and second reservoir compartment 132 to mix and produce production output stream 115. Naturally, depending on the conditions (e.g. permeability, porosity, pressure, and temperature) of each reservoir compartment 131 and 132, each reservoir compartment 131 and 132 will contribute a differing quantity of fluids to production output stream 115.

A continuing challenge in the industry is determining the relative contributions of fluid volumes from each of the reservoir compartments 131 and 132 through time. In some cases, mineral rights to each reservoir compartment 131 and 132 may be owned by different entities. In these cases, producers need to know the relative volume contributions from each reservoir to allocate costs and revenue due each owner.

Conventional methods for allocating production between reservoir compartments include mechanical flow meters and chemical tracers. Each of these conventional methods suffers from a variety of significant disadvantages. Mechanical flow meters not only suffer from high installation costs, but also suffer from unacceptable inaccuracies in many cases. In addition to these problems, mechanical flow meters require physical insertion into the wellbore, which results in significant lost production time. Additionally, mechanical flow meters are often difficult to install. In some non-conventional systems where drilling highly deviated wells and horizontal wells are important strategies in production, mechanical flow meters simply cannot be installed or at best struggle to function due to atypical physical configurations of the wellbore systems. In some cases, the mechanical flow meters are only designed to work well over a certain range of flow rates and hence work poorly or not at all outside of their preferred operating ranges.

Occasionally, chemical tracers are employed to allocate production between reservoir compartments. Chemical tracers such as various radioactive isotopes, may be introduced by way of an injection well in communication with one or more of the reservoir compartments. By measuring the amount of tracer in the commingled production stream, one may be able to estimate the relative contribution of fluid volume from one of the reservoir compartments. Due to this method being notoriously unreliable for production allocation purposes, its use to date has been confined mostly to qualitatively determine whether one reservoir compartment is physically isolated from other compartments (e.g. interference determinations). Additionally, the tracer method is extremely expensive, suffering from one of the highest costs of all of the methods for production allocation.

Accordingly, there is a need in the art for improved systems and methods that address one or more disadvantages of the prior art for allocating production between reservoir compartments.

SUMMARY

The present invention relates generally to methods and systems for allocating production among a plurality of reservoir compartments of a subterranean formation. More particularly, but not by way of limitation, embodiments of the present invention include methods and systems for allocating production among a plurality of reservoir compartments by way of compositional and isotopic analyses.

One example of an allocation method for allocating production among a plurality of reservoir compartments in a subterranean formation comprises the steps of: (a) obtaining a compartment sample from each of the reservoir compartments, each reservoir compartment having a reservoir fluid, wherein each reservoir fluid is characterized by a plurality of components, wherein the plurality of components comprises a plurality of carbon-based components, wherein each carbon-based component of each reservoir compartment comprises a plurality of stable carbon isotopes; (b) analyzing each of the compartment samples to determine a composition fraction of one or more of the carbon-based components of each reservoir compartment; (c) analyzing each of the compartment samples to determine a stable carbon isotope value of the one or more of the carbon-based components of each reservoir compartment; (d) allowing a fluid to flow from each reservoir compartment and commingle to produce a commingled output production stream, the commingled production stream comprised of a relative contribution from each reservoir compartment; (e) analyzing the commingled production stream to determine an output composition of each of the one or more carbon-based components of the commingled output production stream; (f) analyzing the commingled production stream to determine an output stable carbon isotope value of each of the one or more carbon-based components of the commingled output production stream; (g) determining a composition-based relative contribution of fluid from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream; and (h) determining an isotope-based relative contribution of fluid from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream.

In certain embodiments, the composition-based relative contribution may be determined based on (1) the output composition of the commingled production stream and (2) the composition fraction of each of the one or more carbon-based components in each reservoir compartment, and the isotope-based relative contribution may be determined based on (1) the output stable carbon isotope values of the commingled production stream and (2) the stable carbon isotope value of each of the one or more carbon-based components in each reservoir compartment.

In a subterranean formation having a plurality of reservoir compartments, each reservoir compartment having a reservoir fluid, wherein each reservoir fluid is characterized by a plurality of components, wherein the plurality of components comprises a plurality of carbon-based components, wherein each carbon-based component of each reservoir compartment comprises a plurality of stable carbon isotopes, one example of an evaluation method for assessing the effectiveness of an intervention operation, wherein the evaluation method comprises the steps of: (a) analyzing each of the compartment samples to determine a composition fraction of one or more of the carbon-based components of each reservoir compartment; (b) analyzing each of the compartment samples to determine a stable carbon isotope value of the one or more of the carbon-based components of each reservoir compartment; (c) allowing fluid to flow from each reservoir compartment and commingle to produce a commingled output production stream, the commingled production stream comprised of a relative contribution from each reservoir compartment; (d) analyzing the commingled production stream to determine an output composition of each of the one or more carbon-based components of the commingled output production stream; (e) analyzing the commingled production stream to determine an output stable carbon isotope value of each of the one or more carbon-based components of the commingled output production stream; (f) determining a first composition-based relative contribution of each fluid from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream; and (g) determining a first isotope-based relative contribution of fluid from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream; (h) performing the intervention operation in the subterranean formation, the intervention operation having an effect on the relative contribution from each reservoir compartment; (i) after step (h), determining a second composition-based relative contribution of each fluid from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream; (j) after step (h), determining a second isotope-based relative contribution of fluid from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream; and (k) comparing one of (A) the second composition-based relative contribution and (B) the second isotope-based relative contribution to one of ($\alpha$) the first composition-based relative contribution and ($\beta$) the first isotope-based relative contribution to determine an effectiveness of the intervention operation.

One example of an evaluation method for evaluating an effectiveness of applying an allocation method from a first wellbore to a second wellbore, wherein the first wellbore is disposed in a subterranean formation having a plurality of reservoir compartments, each reservoir compartment having a reservoir gas, wherein each reservoir gas is characterized by a plurality of components, each component having a stable carbon isotope value, comprises the steps of: (a) receiving a composition fraction of one or more of the carbon-based components of each reservoir compartment; (b) receiving a stable carbon isotope value of the one or more of the carbon-based components of each reservoir compartment; (c) allowing a second commingled production stream to flow from the second wellbore, the second commingled production stream having a plurality of carbon-based components and a plurality of stable carbon isotopes; (d) receiving an output composition of one or more carbon-based components of the second commingled output production stream; (e) receiving a stable carbon isotope value of one or more stable carbon isotopes of the second commingled output production stream; (f) determining a composition-based relative contribution of gas from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream; and (g) determining an isotope-based relative contribution of gas from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream.

In a subterranean formation, each reservoir compartment having a reservoir gas, wherein each reservoir gas is characterized by a plurality of components, each component having a stable carbon isotope value, one example of an allocation method for allocating production among a plurality of reservoir compartments comprises the steps of: (a) receiving a composition fraction of one or more of the carbon-based components of each reservoir compartment; (b) receiving a stable carbon isotope value of the one or more of the carbon-based components of each reservoir compartment; (c) allowing a gas to flow from each reservoir compartment and commingle to produce a commingled output production stream, the commingled production stream comprised of a relative contribution from each reservoir compartment; (d) receiving an output composition of each of the one or more carbon-based components of the commingled output production stream; (e) receiving a stable carbon isotope value of each of the one or more carbon-based components of the commingled output production stream; (f) determining a composition-based relative contribution of gas from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream; and (g) determining an isotope-based relative contribution of gas from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 1:
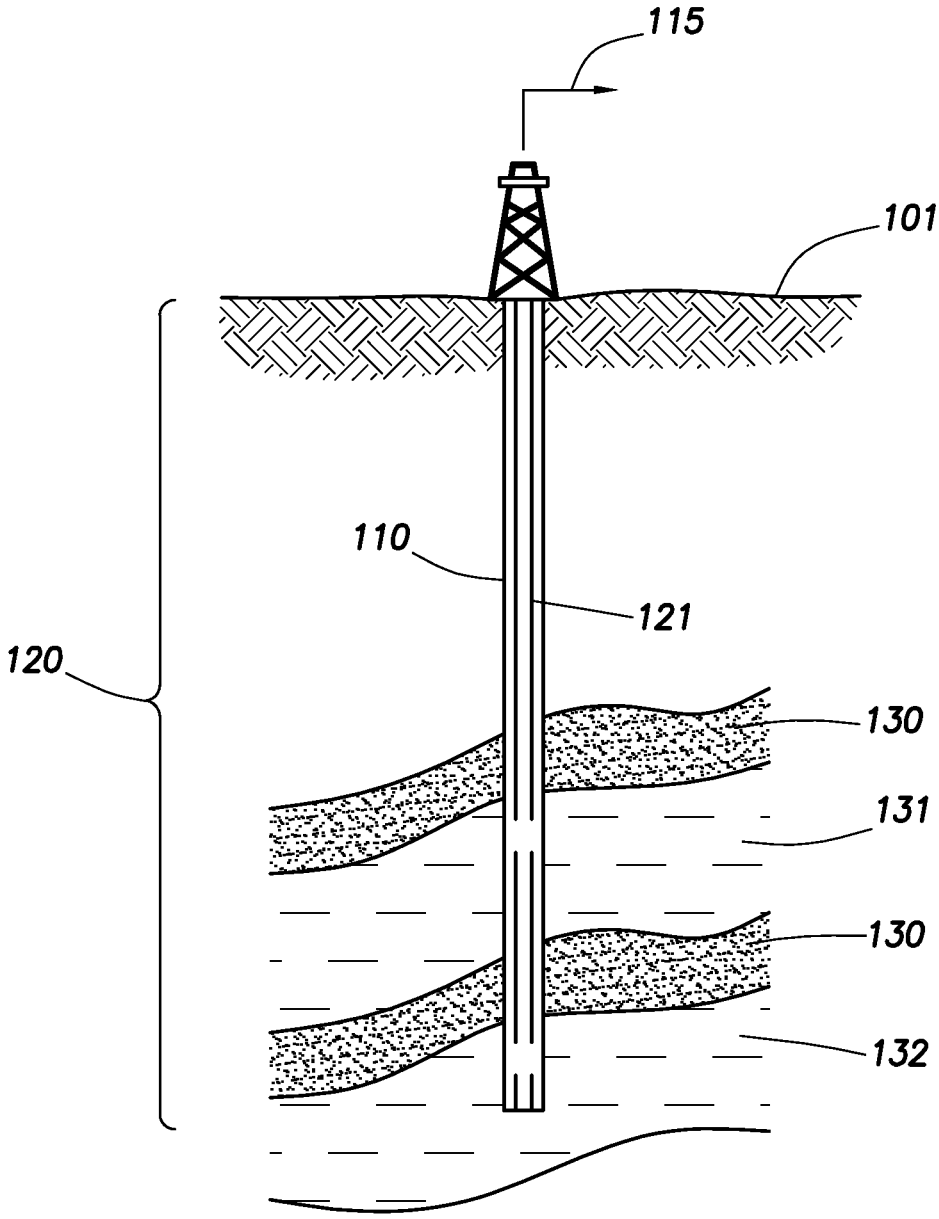
FIG. 1 illustrates a subterranean formation having a plurality of reservoir compartments.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The present invention relates generally to methods and systems for allocating production among a plurality of reservoir compartments of a subterranean formation. More particularly, but not by way of limitation, embodiments of the present invention include methods and systems for allocating production among a plurality of reservoir compartments by way of compositional and isotopic analyses.

Methods and systems are provided for allocating production among a plurality of reservoir compartments of a subterranean formation. That is, where individual reservoir compartments contribute differing amounts of fluid flow to a commingled production stream, the methods herein determine the relative contribution of fluid volumes from each reservoir compartment.

In certain embodiments, both a composition-based relative contribution of fluid from each reservoir compartment and an isotope-based relative contribution of fluid from each reservoir compartment may be determined to allocate production to each reservoir compartment.

The composition-based relative contribution analysis relies on performing a component mass balance, knowing the composition of each reservoir compartment, which defines the end-member composition, as well as the composition of a commingled production stream. The isotope-based relative contribution analysis relies on performing a carbon isotope mass balance, knowing the carbon isotope values of each reservoir compartment, which defines the end-member isotopic values, as well as the carbon isotope values of a commingled production stream. The combination of the composition-based and the isotope-based allocation provides a quality check on the allocation results that allow identification of improper allocations that might arise from individual compounds.

In addition to allocating production among a number of reservoir compartments, other applications of the methods herein include, but are not limited to, determining the effectiveness of an intervention operation (such as a stimulation operation) on a particular reservoir compartment. That is, one may determine the impact of the intervention operation on a particular reservoir compartment by comparing the allocation of production among reservoir compartments before and after the intervention operation. In addition to evaluating the effectiveness of intervention operations, production allocation estimates can also provide useful feedback for adjusting production operations as described further below.

Advantages of certain embodiments of the present invention include, but are not limited to, lower cost, higher accuracy, and ease of use without significantly affecting oil field operations as compared to conventional methods.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

Figure 2:
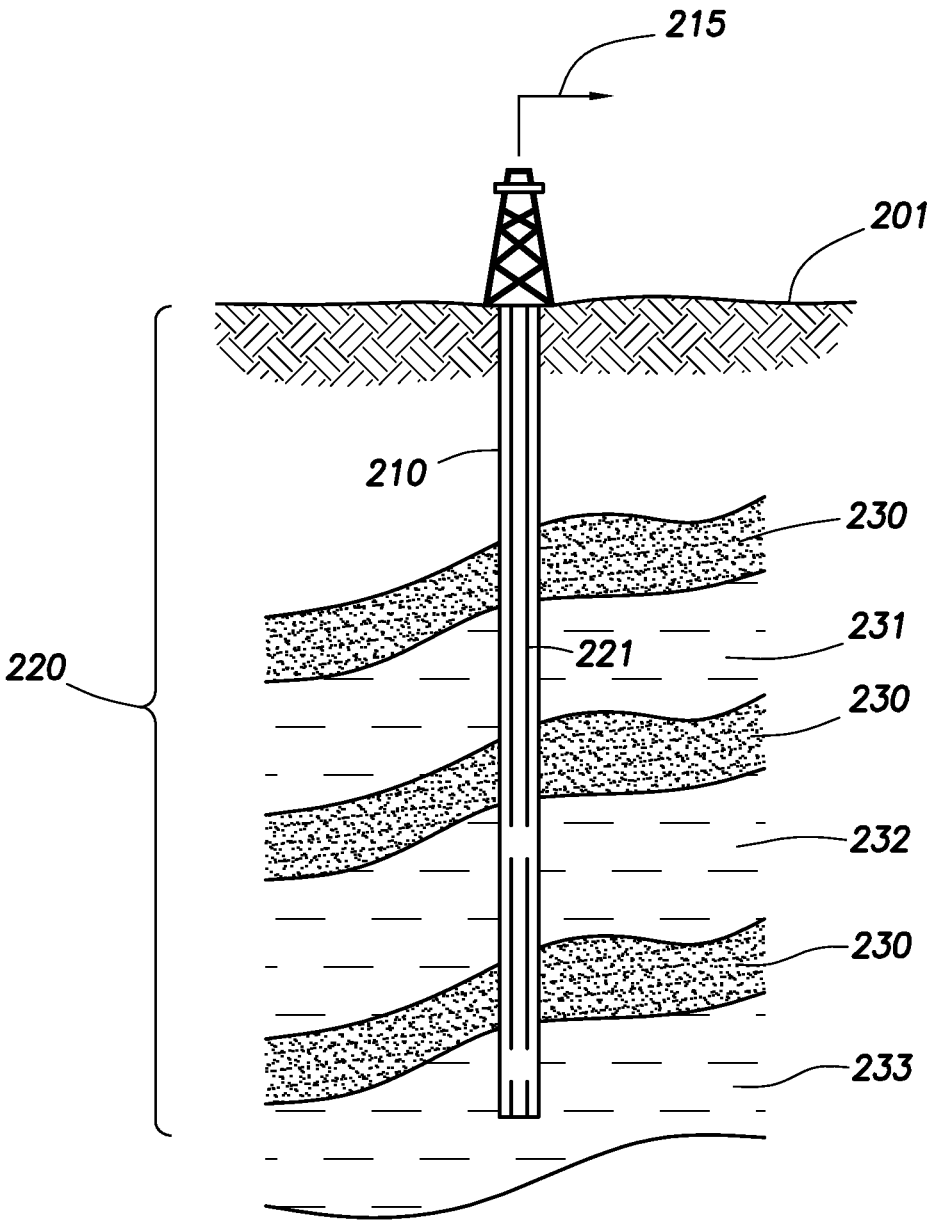
FIG. 2 illustrates a subterranean formation having a plurality of reservoir compartments in accordance with one embodiment of the present invention.

FIG. 2 illustrates a schematic of a subterranean formation having a plurality of reservoir compartments in accordance with one embodiment of the present invention. Although certain embodiments are shown here with two or three reservoir compartments, it is recognized that the methods herein may be applied to any number of reservoir compartments.

Here, wellbore 210 is disposed in subterranean formation 220 with casing 221. Subterranean formation comprises first reservoir compartment 231, second reservoir compartment 232, and third reservoir compartment 233, each reservoir compartment 231, 232, and 233 capable of producing hydrocarbons. Reservoir compartments 231, 232, and 233 are bounded by impermeable barriers 230, here shown as shale layers that isolate each reservoir compartment 231, 232, and 233 from one another. Casing 221 is perforated at each reservoir compartment to allow hydrocarbon to be produced via wellbore 210 to surface 201. Fluid volumes from each reservoir compartment 231, 232, and 233 commingles to produce commingled production stream 215. The fluid from each reservoir compartment may be a liquid, gas, or combination thereof.

The methods disclosed herein endeavor in part to ascertain the relative contribution of fluid volumes from each of the reservoir compartments 231, 232, and 233 that contribute to produce commingled production stream 215. As alluded to previously, both a composition-based relative contribution and an isotope-based relative contribution are determined to ascertain how much fluid volume each reservoir compartment 231, 232, and 233 contributes to commingled production stream 215.

Figure 3:
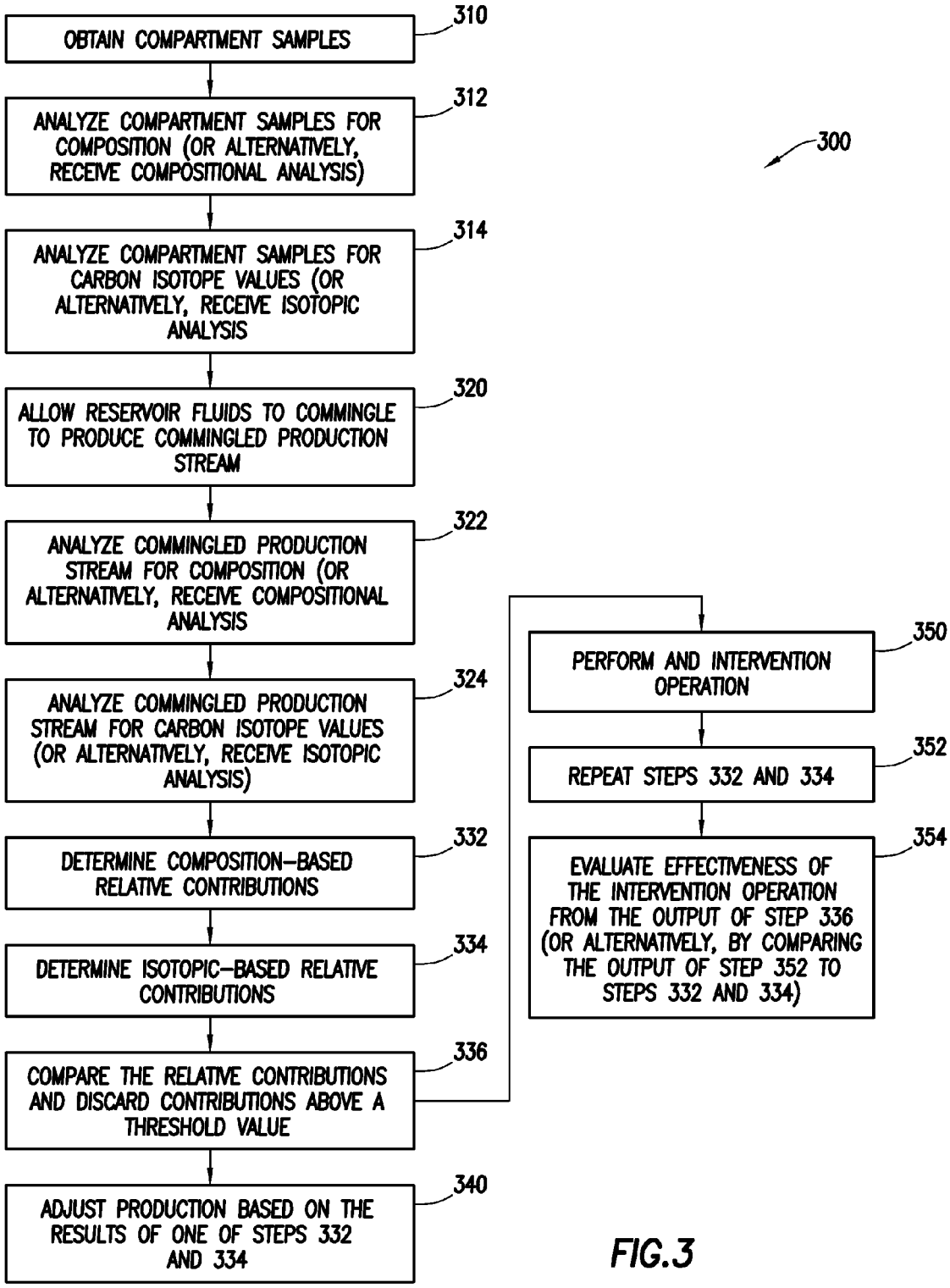
FIG. 3 illustrates a flow chart for a method for allocating production among a plurality of reservoir compartments in a subterranean formation in accordance with one embodiment of the present invention.

FIG. 3 illustrates a flow chart for a method for allocating production among a plurality of reservoir compartments in a subterranean formation in accordance with one embodiment of the present invention. Method 300 of FIG. 3 is explained with reference to the system depicted in FIG. 2. Again, although this embodiment is illustrated as applying to three reservoir compartments, it is recognized the methods herein may be applied to any number of reservoir compartments provided that sufficient chemical and/or isotope variability exists among the reservoir compartments.

Method 300 commences with step 310. In step 310, samples of each reservoir compartment 231, 232, and 233 are obtained. Each reservoir compartment 231, 232, and 233 comprises a plurality of components. Petroleum fluids in each reservoir compartments 231, 232, and 233 may be geochemically different owing to either different source rock facies which generated the petroleum fluids that charged the different compartments or similar source rock facies but charging the compartments at different stages of its thermal history or a combination of these two geologic processes. Similarly, intra-reservoir alterations processes such as biodegradation, water washing, oil to gas cracking and other post-petroleum charge geologic processes may also affect chemical variation in the petroleum fluids in reservoir compartments 231, 232, and 233. Because the hydrocarbons of each reservoir compartment 231, 232, and 233 were subject to different geological conditions during their geologic evolution, the composition of each compartment 231, 232, and 233 differs from one another.

Likewise, for the same reasons, the components of each reservoir compartment 231, 232, and 233 contain a different distribution of carbon isotopes. That is, one reservoir compartment may have hydrocarbon components that contain more stable $^{12}C$ carbon isotope as compared to $^{13}C$ carbon isotope than another reservoir compartment. These differences in composition and carbon isotope values allow the mathematical comparisons and computations described below to allocate production among the reservoir compartments.

In step 312, the reservoir compartment petroleum fluid samples are analyzed to determine the composition of fluid in each reservoir compartment 231, 232, and 233. The composition of each compartment may be analyzed by any device suitable for determining a fluid composition, including, but not limited to gas chromatography (GC) devices with a flame ionization detector (FID) or a thermal conductivity detector (TCD). The individual reservoir compartment samples may be obtained during drilling from the mud gas to establish the composition of the pure end-member from each compartment or by any other suitable method such as single compartment production by a stand alone well in proximity to wellbore 210, which may only penetrate one of the compartments. These proximal wells (not shown) to wellbore 210 that penetrate a single compartment would help to constrain end member composition in the compartment they penetrate.

In step 314, the compartment samples obtained in step 310 are analyzed for stable carbon ($C^{13}$) isotope values of individual hydrocarbon compounds. Stable carbon isotope values referred to here are relative to the PeeDee Beleminite standard (PDB) and represented by $$\delta^{13}C = \left( \frac{\frac{^{13}C}{^{12}C}\text{sample}}{\frac{^{13}C}{^{12}C}\text{standard}} - 1 \right) \cdot 1000.$$

It is recognized that either steps 312 and 314, may alternatively be performed by simply receiving the composition and isotopic analyses in lieu of obtaining and analyzing compartment samples, for example, by allowing another to obtain and analyze the samples. Accordingly, where steps 312 and 314 are alternatively performed by simply receiving the composition and isotopic analyses from another, step 310 may optionally be omitted from method 300.

In step 320, fluid from each reservoir compartment 231, 232, and 233 mixes to produce commingled production stream 215. Commingled production stream 215 may then be analyzed for its composition and stable carbon isotope values as provided in steps 322 and 324.

As before, it is recognized that either steps 322 and 324, may alternatively be performed by simply receiving the composition and isotopic analysis. Accordingly, the composition and isotopic analysis of the methods herein may be obtained by direct analysis of commingled production stream 215, by obtaining and analyzing samples of commingled production stream 215, or by simply receiving these analyses from another.

In certain embodiments, the composition results and the isotopic values obtained for each reservoir compartment in steps 322 and 324 may be normalized before being used in the calculations described below by excluding any non-carbon based components and then normalizing the remaining carbon-based components to the total hydrocarbons. In certain other embodiments, normalization may be applied more broadly to certain components of interest by excluding components of non-interest, and normalizing the remaining components of interest against the total combination of the components of interest.

In step 332, a composition-based relative contribution of each fluid from each reservoir compartment is determined by solving a mass balance system of equations for each of the hydrocarbon components of interest. As described further below, the composition data may be recast as ratios either to other hydrocarbon components or to the total hydrocarbon composition prior to performing the mass balance system of equations. The mass balance system of equations is characterized by a mass balance of each of the carbon-based components from each reservoir compartment mixing to produce the commingled output production stream. By way of example, suppose that each reservoir compartment 231, 232, and 233 comprised various quantities of methane, ethane, propane, and butane. As part of step 332, one could perform a mass balance on one or more of these components. For example, a mass balance could be performed on just ethane or any combination or subcombination of these components. Such a mass balance when carried out for two components (e.g. methane and ethane) over three reservoir compartments leads to the following mass balance equations:

$$(C_{1,A})(A)+(C_{1,B})(B)+(C_{1,C})(C)=C_{1,mix} \quad \text{[Equation 1]}$$

$$(C_{2,A})(A)+(C_{2,B})(B)+(C_{2,C})(C)=C_{2,mix} \quad \text{[Equation 2]}$$

$$A+B+C=1 \quad \text{[Equation 3]}$$

where the variable $C_{1,j}$ refers to the mole fraction or volume fraction of methane (or any first component of interest) in reservoir compartment j, that is, one of reservoir compartments A, B, or C;

where the variable $C_{2,j}$ refers to the mole fraction or volume fraction ethane (or any second component of interest) in reservoir compartment j, that is, one of reservoir compartments A, B, or C; and where the variables A, B, and C each refer to the relative volume fraction contribution of fluid from each reservoir compartment A, B, and C respectively.

To solve the system of equations for production allocation, the equations may be simultaneously solved through well-known matrix algebra techniques or by algebraic substitution as desired. As mentioned directly above, in certain preferred embodiments, normalized or non-normalized values of the compositions are used in these mass balance equations.

Likewise, for illustrative purposes, for a system of three components over two reservoir compartments, such a system would lead to the following mass balance equations:

$$(C_{1,A})(A)+(C_{1,B})(B)=C_{1,mix} \quad \text{[Equation 4]}$$

$$(C_{2,A})(A)+(C_{2,B})(B)=C_{2,mix} \quad \text{[Equation 5]}$$

$$(C_{3,A})(A)+(C_{3,B})(B)=C_{3,mix} \quad \text{[Equation 6]}$$

$$A+B=1 \quad \text{[Equation 7]}$$

Obviously, one only needs to solve a number of equations that correspond to the number of reservoir compartments. Therefore, in some systems, not all equations need to be simultaneously solved to render a valid determination of the relative contributions from each reservoir compartment.

These component mass balance equations may be extended to any number of components and any number of compartments by generalizing the above equations and expressing them more generally as follows:

$$\sum_{j=1}^{a}\sum_{i=1}^{b} C_{i,j}\cdot(x) = C_{i,mix} \quad \text{[Equation 8]}$$

$$\sum_{j=1}^{a} x = 1 \quad \text{[Equation 9]}$$

where the variable "a" refers to the total number of reservoir compartments;

where the variable "b" refers to the total number of carbon-based components;

where the variable $C_{i,j}$ refers to the mole fraction or volume fraction of component i in reservoir compartment j (e.g. one of reservoir compartments A, B, C, etc.); and where the variables x refers to the volume fraction contribution of fluid volume from each reservoir compartment j (e.g. one of reservoir compartments A, B, C, etc.).

Again, while this generalized representation may yield a large number of equations, in some cases, only a subset of the resulting equations need be solved to render the desired results. In this way, the relative contribution from each reservoir compartment 231, 232, and 233 may be determined through solving the above-described system of equations based on knowing the composition of each reservoir compartment and the composition of the commingled production stream 215.

In step 334, an isotope-based relative contribution of each carbon isotope of each hydrocarbon component from each reservoir compartment is determined by solving another mass balance system of equations for each of the carbon isotopes of interest. This second mass balance system of equations is characterized by a mass balance of each of the carbon isotopes from each reservoir compartment mixing to produce the commingled output production stream.

$$(\delta C_{1,A})(C_{1,A})(A)+(\delta C_{1,B})(C_{1,B})(B)=(\delta C_{1,mix})(C_{1,mix}) \quad \text{[Equation 10]}$$

$$(\delta C_{2,A})(C_{2,A})(A)+(\delta C_{2,B})(C_{2,B})(B)=(\delta C_{2,mix})(C_{2,mix}) \quad \text{[Equation 11]}$$

$$(\delta C_{3,A})(C_{3,A})(A)+(\delta C_{3,C})(C_{3,B})(B)=(\delta C_{3,mix})(C_{3,mix}) \quad \text{[Equation 12]}$$

$$A+B=1 \quad \text{[Equation 13]}$$

where $\delta C_{i,j}$ refers to the stable carbon isotope value of component i for reservoir compartment j (e.g. one of reservoir compartments A or B);

where the variable $C_{i,j}$ refers to the mole fraction or volume fraction of component i in reservoir compartment j; and where the variable A refers to the volume fraction contribution of fluid volume from reservoir compartment A and where the variable B refers to the volume fraction contribution of fluid volume from reservoir compartment B.

These carbon isotope mass balance equations may be extended to any number of components and any number of compartments by generalizing the above equations and expressing them more generally as follows:

$$\sum_{j=1}^{a}\sum_{i=1}^{b} (\delta C_{i,j})(C_{i,j})\cdot(x) = (\delta C_{i,mix})(C_{i,mix}) \quad \text{[Equation 14]}$$

$$\sum_{j=1}^{a} x = 1 \quad \text{[Equation 15]}$$

where the variable "a" refers to the total number of reservoir compartments;

where the variable "b" refers to the total number of carbon-based components;

where the variable $\delta C_{i,j}$ refers to the stable carbon isotope value of component i in reservoir compartment j;

where the variable $C_{i,j}$ refers to the mole fraction or volume fraction of component i in reservoir compartment j; and where the variables x refers to the volume fraction contribution of fluid volume from each reservoir compartment j.

As before, depending on the system being analyzed, any subset of this general set of equations may be simultaneously solved, provided that a sufficient number of equations are employed to solve for the number of unknowns, which in this case equals the number of compartments. Also as before, the mole fractions above may be normalized or non-normalized values as desired by discarding any components of non-interest.

In this way, step 334 estimates the relative fluid contributions from each reservoir compartment based on the carbon isotopic values of each component in each reservoir compartment and the carbon isotopic values of each component in the commingled output production stream.

Thus, both steps 332 and 334 estimate the relative fluid contributions to commingled production stream 215 from each of the reservoir compartments 231, 232, and 233. Due to measurement analysis errors, some of the estimates result in erroneous values clearly outside of a valid range. For example, fractions below 0 or above 1 may be discarded as obviously erroneous values. In certain embodiments, the erroneous values are not discarded, but instead may be output to a user. These erroneous values may be useful to indicate unexpected interference of one the reservoir compartments with another reservoir compartment or nearby well.

Additionally, in step 336, the validity of each determination may optionally be confirmed by comparing the relative contribution determination from step 332 to the relative contribution determination from step 334 for each component or carbon isotope of interest. Any discrepancy beyond an acceptable tolerance threshold level may be discarded as an erroneous result. While any threshold level may be used with the present invention, examples of suitable threshold levels include, but are not limited to, threshold levels of no more than about 2 percent, no more than about 20 percent, between about 2 and about 20 percent, and less than about 15 percent.

Method 300 also contemplates additional optional steps if desired. In certain embodiments, the results or output of step 336 (or alternatively, the output of one or both of the steps 332 and 334) may be used to adjust production from one or more of the reservoir compartments, such as by adjusting the relative contribution of fluid from each reservoir compartment. In some cases, for example, upon the relative contribution from a reservoir compartment falling below a threshold production level, the operator may decide to further decrease or shut-in the low-production reservoir compartment in favor of producing from the other reservoir compartments or alternatively, in favor of producing from a new reservoir compartment.

Alternatively, method 300 also contemplates using the steps herein to evaluate the effectiveness of an intervention operation. The term, "intervention operation," as used herein refers to any operation in a subterranean formation that affects hydrocarbon production including, but not limited to, stimulation operations (e.g. acid stimulation, fracturing, etc), secondary operations (e.g. water and steam flooding), consolidation operations, or any combination thereof.

In step 350, an intervention operation is performed. By way of example, a fracturing operation may be carried out on second reservoir compartment 232 in an effort to increase production from second reservoir compartment 232. Subsequent to the intervention operation, one may desire to evaluate the effectiveness of the intervention operation. Step 352 contemplates repeating steps 332 and 334 after the intervention operation. Redetermining the relative contributions of fluid from each reservoir compartment allows an operator to assess the effectiveness of the intervention operation. For example, if the relative contribution from the second reservoir compartment 232 increases dramatically after the intervention operation, the degree of increase would suggest the level of success or effectiveness of the intervention operation.

Figure 4:
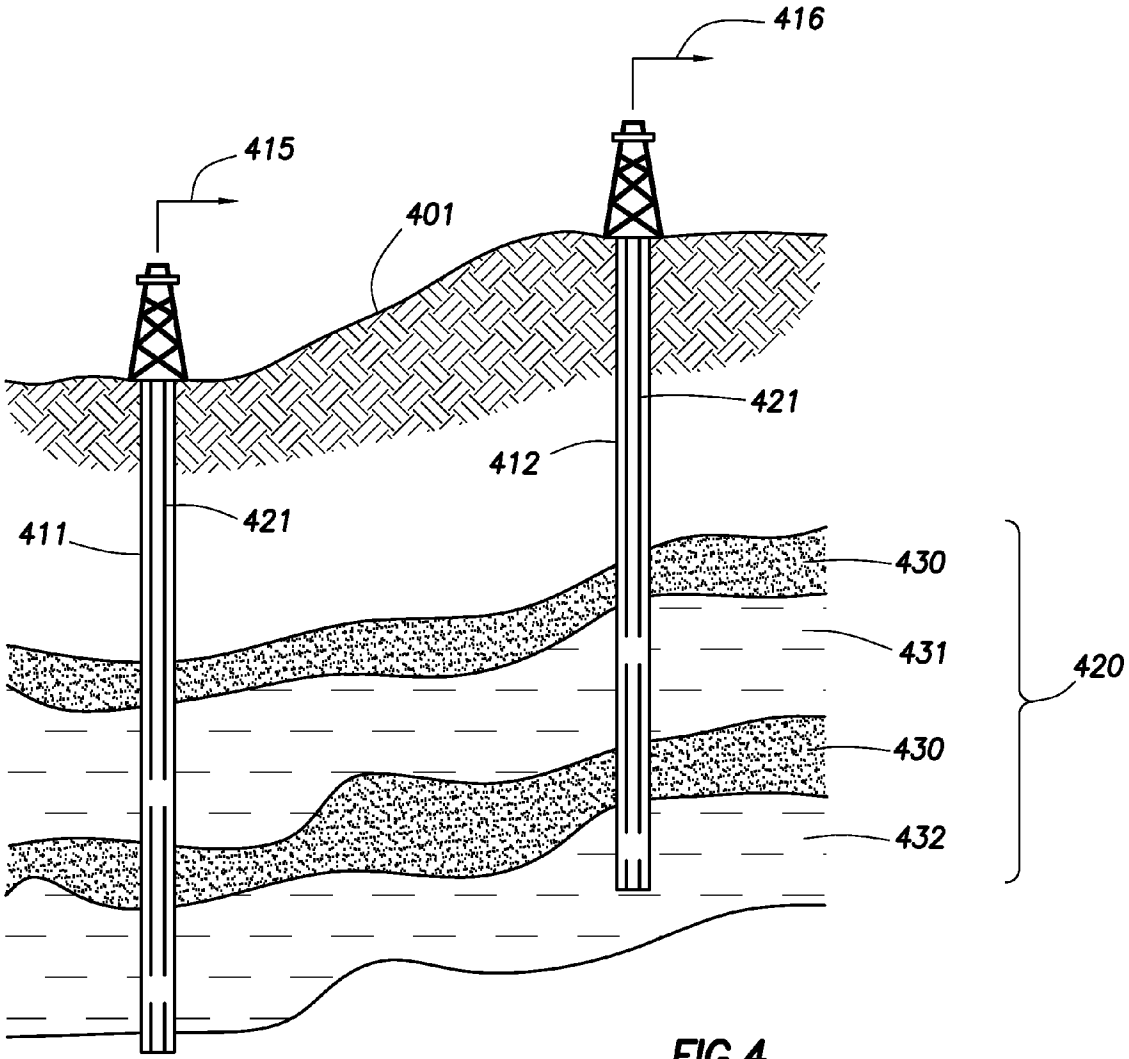
FIG. 4 illustrates a subterranean formation with a first wellbore and a second wellbore, each wellbore intersecting a first reservoir compartment and a second reservoir compartment in accordance with one embodiment of the present invention.

FIG. 4 illustrates a subterranean formation with a first wellbore and a second wellbore, each wellbore intersecting a first reservoir compartment and a second reservoir compartment in accordance with one embodiment of the present invention. Here, first wellbore 411 and second wellbore 412 are disposed in subterranean formation 420 with casing 421. First wellbore 411 and second wellbore 412 intersect first reservoir compartment 431 and second reservoir compartment 432 for producing first commingled production stream 415 and second commingled production stream 416. Method 500 of FIG. 5 is explained with reference to the system depicted in FIG. 4.

Figure 5:
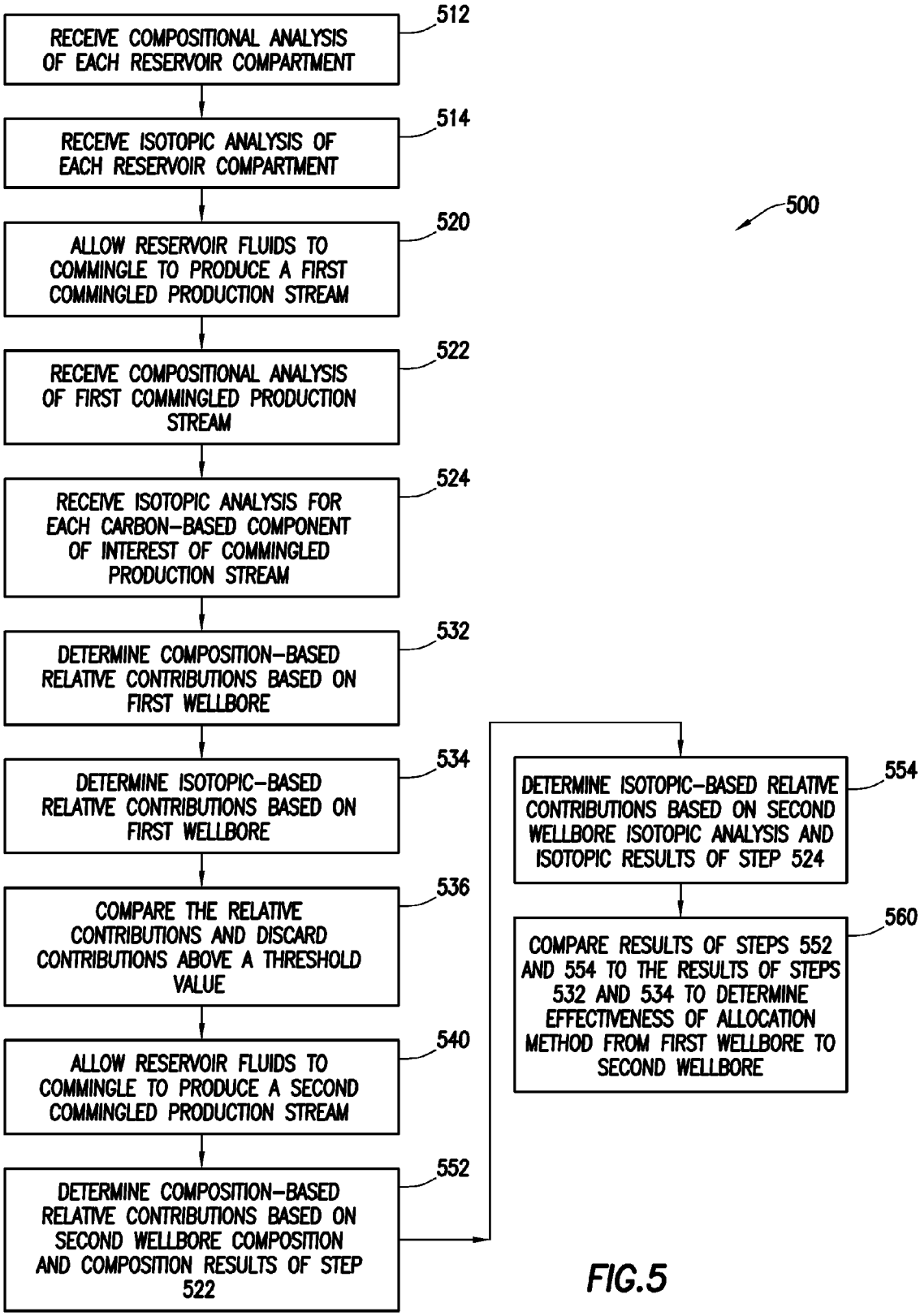
FIG. 5 illustrates a flow chart for a method for evaluating the effectiveness of applying an allocation method from a first wellbore to a second wellbore in accordance with one embodiment of the present invention.

FIG. 5 illustrates a flow chart for a method for evaluating the effectiveness of applying an allocation method from a first wellbore to a second wellbore in accordance with one embodiment of the present invention.

In some cases, an operator may desire to know whether an allocation analysis of a first wellbore could be successfully applied to a second wellbore in an adjacent block. In the system depicted in FIG. 4, one would expect accurate results performing the same allocation analysis to second wellbore 412 when relying on the same composition and isotopic analyses obtained during drilling of first wellbore 411 and second wellbore 412, because second wellbore 412 presumably produces from the same reservoir compartments 431 and 432 as first wellbore 411.

Often however, an allocation analysis from one wellbore will not translate to a second wellbore when the second wellbore is producing from reservoir compartments that differ from the reservoir compartments of the first wellbore. Accordingly, it may be desired to ascertain whether reservoir compartment analyses from one wellbore may be successively used in an allocation analysis as applied to a second wellbore. Method 500 endeavors to answer that question.

Method 500 commences with step 512. In step 512, compositional analyses for each component of interest are received for each reservoir compartment 431 and 432. In step 514, analyses of the C isotope values for each carbon-based component of interest are received for each reservoir compartment 431 and 432.

In step 520, reservoir fluids are allowed to flow from each reservoir compartments 431 and 432 to produce first commingled production stream 415. In step 522, a composition analysis is received for first commingled production stream 415. In step 524, carbon isotope values are received for each carbon-based component of interest for first commingled production stream 415.

In step 532, a composition-based relative contribution is determined based on the compositions received and in step 534, an isotope-based relative contribution is determined based on the isotope values received. In certain embodiments, only one of steps 532 and 534 is performed. If desired, each of the results from steps 532 and 534 may be compared for validation purposes and erroneous values may be discarded in optional step 536.

In this way, an allocation of production for first wellbore 411 between reservoir compartments 431 and 432 is determined.

In step 540, second commingled production stream 416 is produced from second wellbore 432. In step 552, composition-based relative contributions are determined for the second commingled production stream 416 using the end-members composition for the different hydrocarbons constrained in step 512 in the first wellbore 415. In step 554, isotopic-based relative contributions are determined for the second commingled stream 416 using the end-member isotopic values for the different hydrocarbons in step 514 in the first wellbore 416. As before, both steps 552 or 554 may be performed, or alternatively, either step 552 or 554 may be performed as desired.

Optionally, in step 560, the results of one of the steps 552 and 554 may be compared to the results of one of the steps 522 and 524, if desired. In this way, one may determine the applicability of an allocation analysis from a first wellbore to a second wellbore.

In certain embodiments, method 500 may be performed without optional steps 520, 522, 524, 532, 534, 536, 560, or any combination thereof. Where all of these steps are omitted, the remaining steps allow for determining an allocation production at a second wellbore using the end-member compositions of the first wellbore.

Figure 6A:
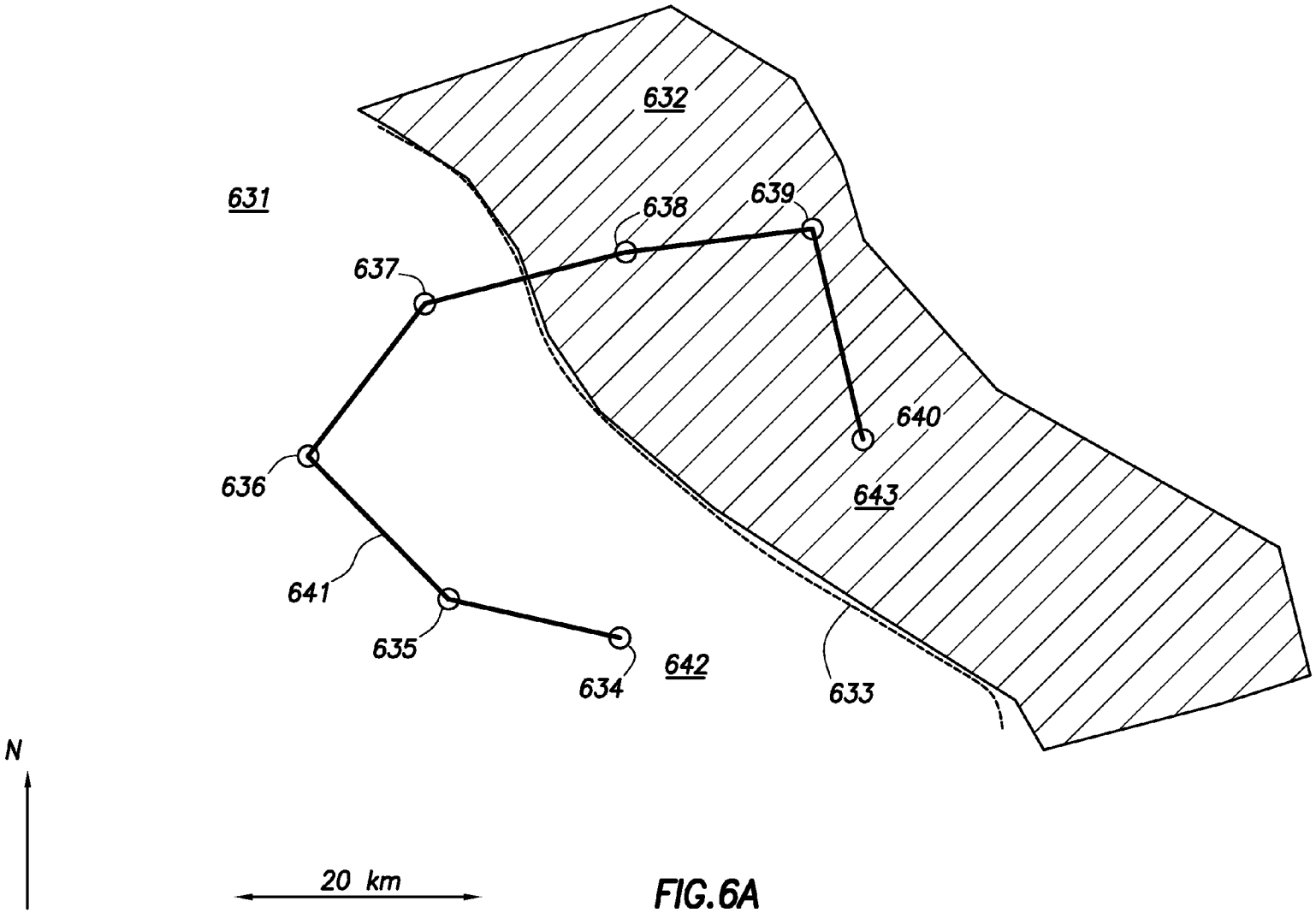
FIG. 6A illustrates an aerial view of a plurality of wells spanning across multiple fields.
Figure 6B:
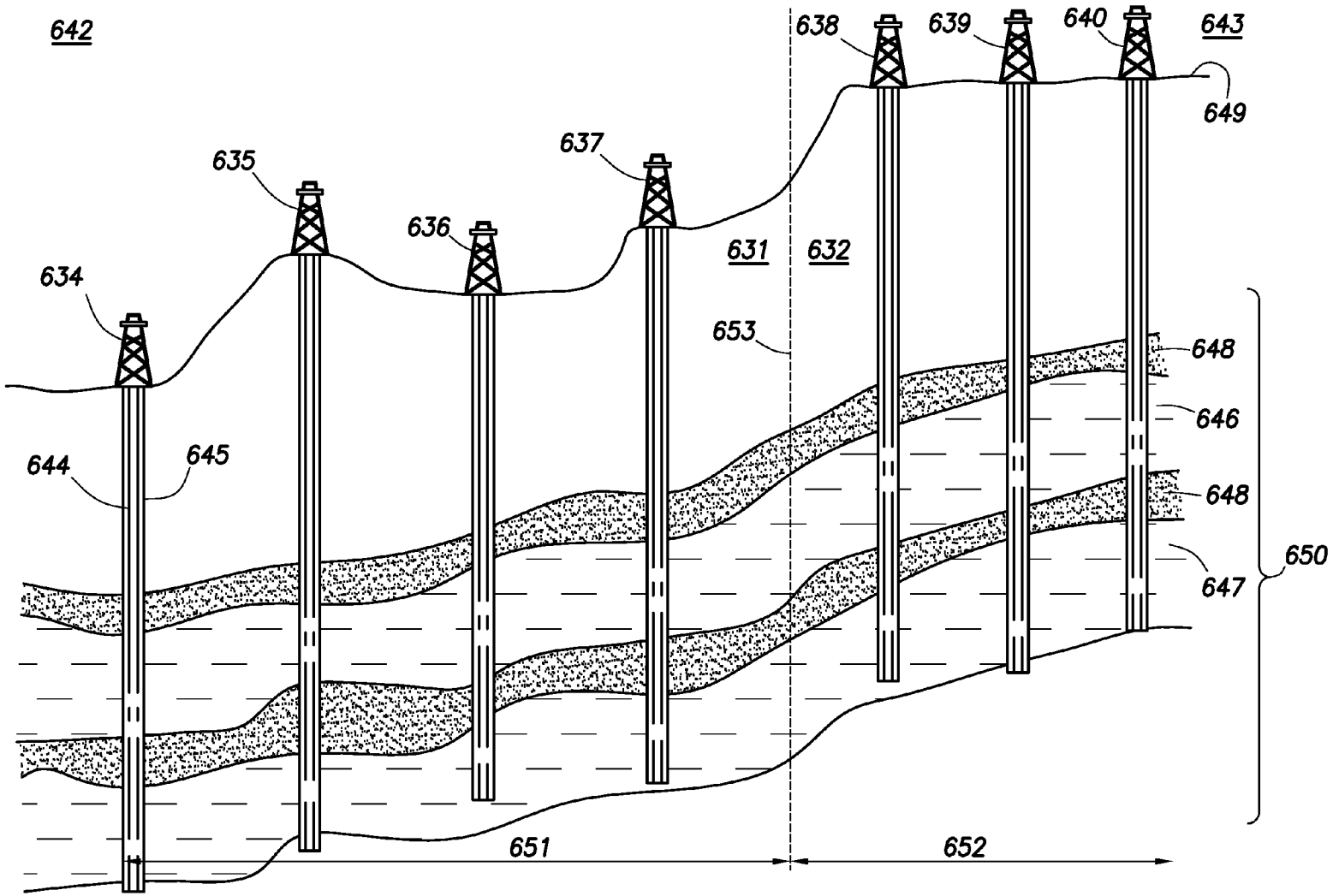
FIG. 6B illustrates a side view of the wells depicted in FIG. 6A, each well disposed in a plurality of reservoir compartments.

FIG. 6A illustrates an aerial view of a plurality of wells spanning across multiple fields. FIG. 6B illustrates a side view of the wells depicted in FIG. 6A, each well disposed in a plurality of reservoir compartments. More particularly, several pre-existing comingled production wells 634, 636, 637, 638 and 639 intersecting a plurality of reservoir compartments 646 and 647. New production wells 635 and 640 are also shown in FIGS. 6A and 6B.

The gas geochemistry methods herein may also be extended to evaluate the applicability of production allocation methods to new production wells (e.g. wells 635 and 640) in a given field. For example, one may desire to know the extent of the applicability of production allocation methods to one or more new wells. This method takes advantage of a couple of new production wells 635 and 640 for this study area to constrain the end member composition and isotope value for each carbon based component required for production allocation. Better still, gas data collected from wells completed in single compartments may also be used in this application to define the end-member composition and isotope value for each compartment. This application also helps identify the lateral/areal extent to which constrained end-member composition and isotope values can be suitably applied in production allocation in a given area. In this case, end-member for the carbon based components from the plurality of reservoir compartments from well 635 can be applied successfully in production allocation for wells along cross section 642-643 for lateral extent 651 thus defining area 631. Similarly, the end-member for the carbon based components from the plurality of reservoir compartments from well 640 can be applied successfully in production allocation for wells along cross-section 642-643 for lateral extent 652 thus defining area 632.

Figure 7:
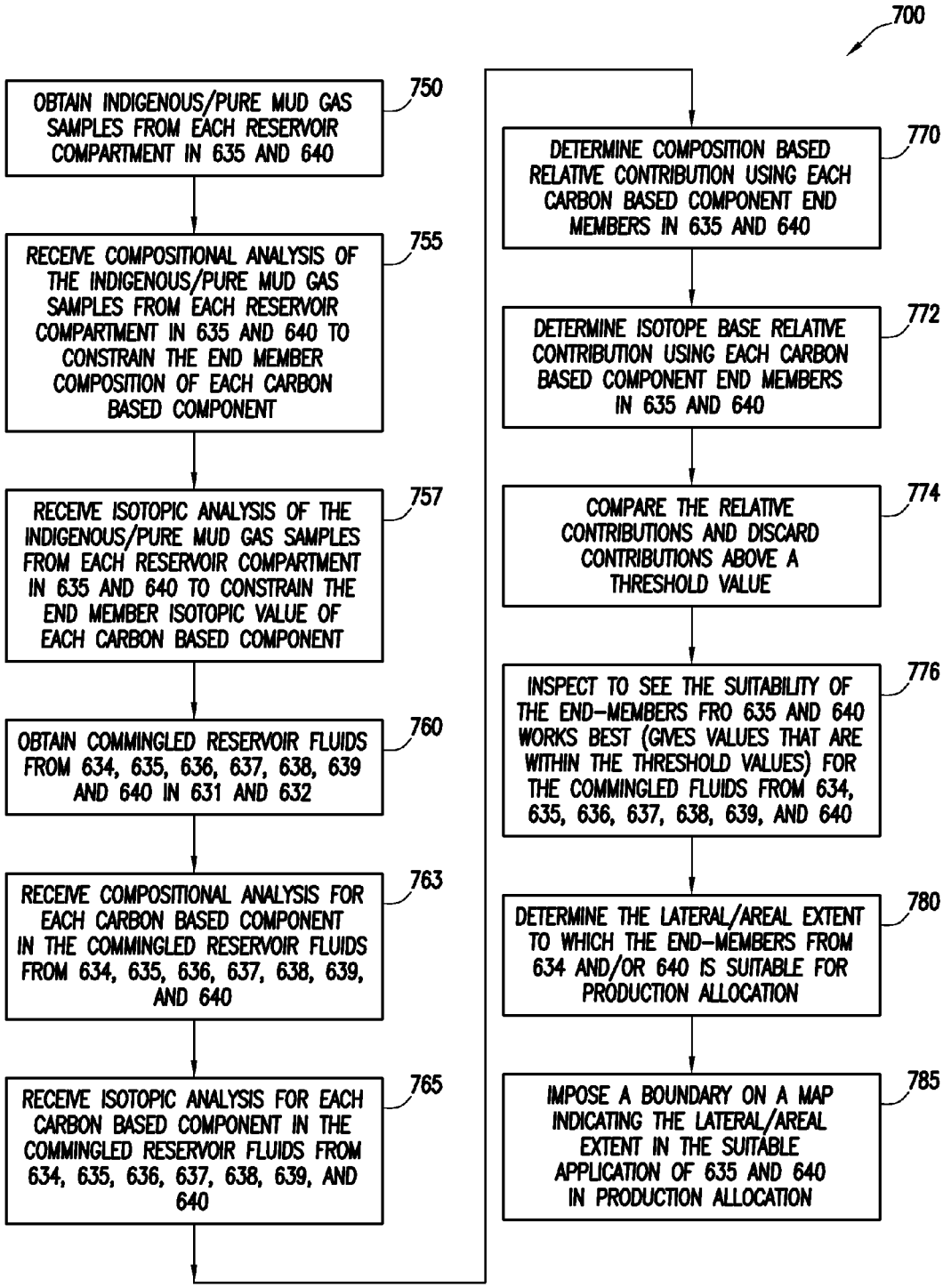
FIG. 7 illustrates one example of applying a production allocation method to determine the lateral/areal extent to which constrained end-member composition and isotope values can be suitably applied in production allocation in a given area.

Method 700, depicted in FIG. 7, illustrates one example of applying this method. In step 750, indigenous/pure mud gas samples are obtained from each reservoir compartment 635 and 640. In step 755, compositional analysis of the indigenous/pure mud gas samples are analyzed or received from each reservoir compartment in 635 and 640 to constrain the end member composition of each carbon based component. In step 757, isotopic analyses are analyzed or received of the indigenous/pure mud gas samples from each reservoir compartment in 635 and 640 to constrain the end member isotopic value of each carbon based component.

In step 760, comingled reservoir fluids from 634, 635, 636, 637, 638, 639 and 640 in 631 and 632 are obtained. In step 763, the commingled reservoir fluids from 634, 635, 636, 637, 638, 639 and 640 are analyzed for their composition (or alternatively, the compositional analyses are received from another). Step 765 contemplates receiving isotopic analyses for each carbon-based component in the comingled reservoir fluids from 634, 635, 636, 637, 638, 639 and 640. In step 770, composition-based relative contributions are determined based on each carbon-based component end members in 635 and 640. In step 772, isotope based relative contribution are determined based on each carbon-based component end member in 635 and 640. In step 774, the relative contributions are compared and as before, any relative contributions above a certain tolerance threshold value are discarded.

In step 776, the suitability of the end members from 635 and 640 are inspected to see which end members yield the best results for the comingled fluids from 634, 635, 636, 637, 638, 639 and 640 (e.g. which end members yield values within the tolerance threshold levels). In step 780, the lateral/areal extent to which the end-members from 635 and/or 640 is suitable for production allocation is determined Then, in step 785, a boundary may be imposed on a map indicating the lateral/areal extent in the suitable application of 635 and 640 in production allocation.

To facilitate a better understanding of the present invention, the following examples of certain embodiments are given. In no way should the following examples be read to limit, or define, the scope of the invention.

EXAMPLES

Example 1

Figure 8A:
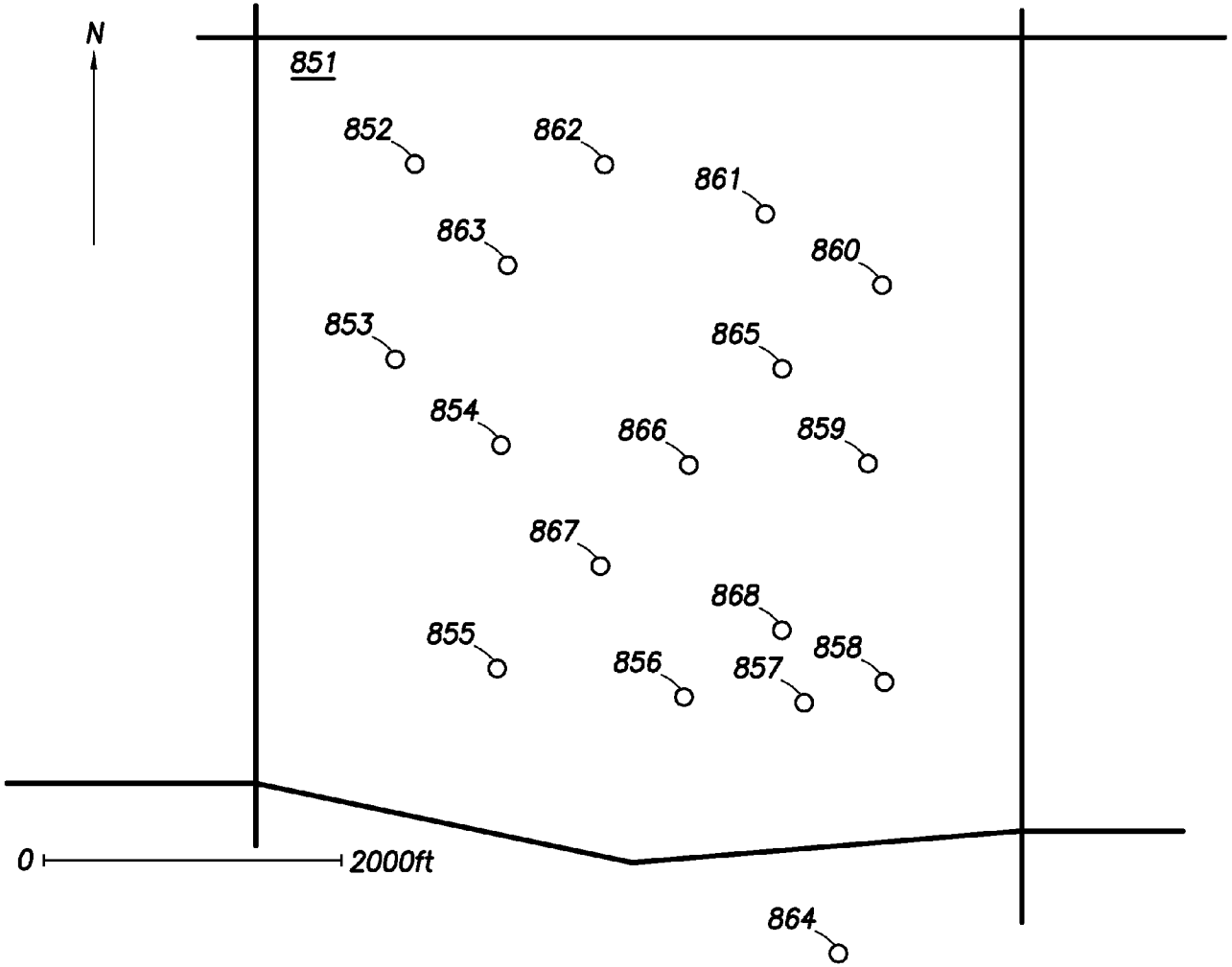
FIG. 8A shows an aerial map of a plurality of wells.

To assess the accuracy and reproducibility of certain embodiments of the methods herein, production allocation methods by isotopic analysis were compared to production allocation methods by compositional analysis. In this example, production allocation gas geochemistry data is applied wherein one well (855) with a plurality of compartments is used to constrain the end member composition and isotope values for each compartments and these end members for each carbon components are in turn applied in allocating comingled reservoir fluids from adjacent wells (852, 853, 854, 856, 857, 858, 859, 860, 861, 862, 863, 864, 865, 866, 867 and 868) through time in a given area 851 (FIG. 8A).

Figure 8B:
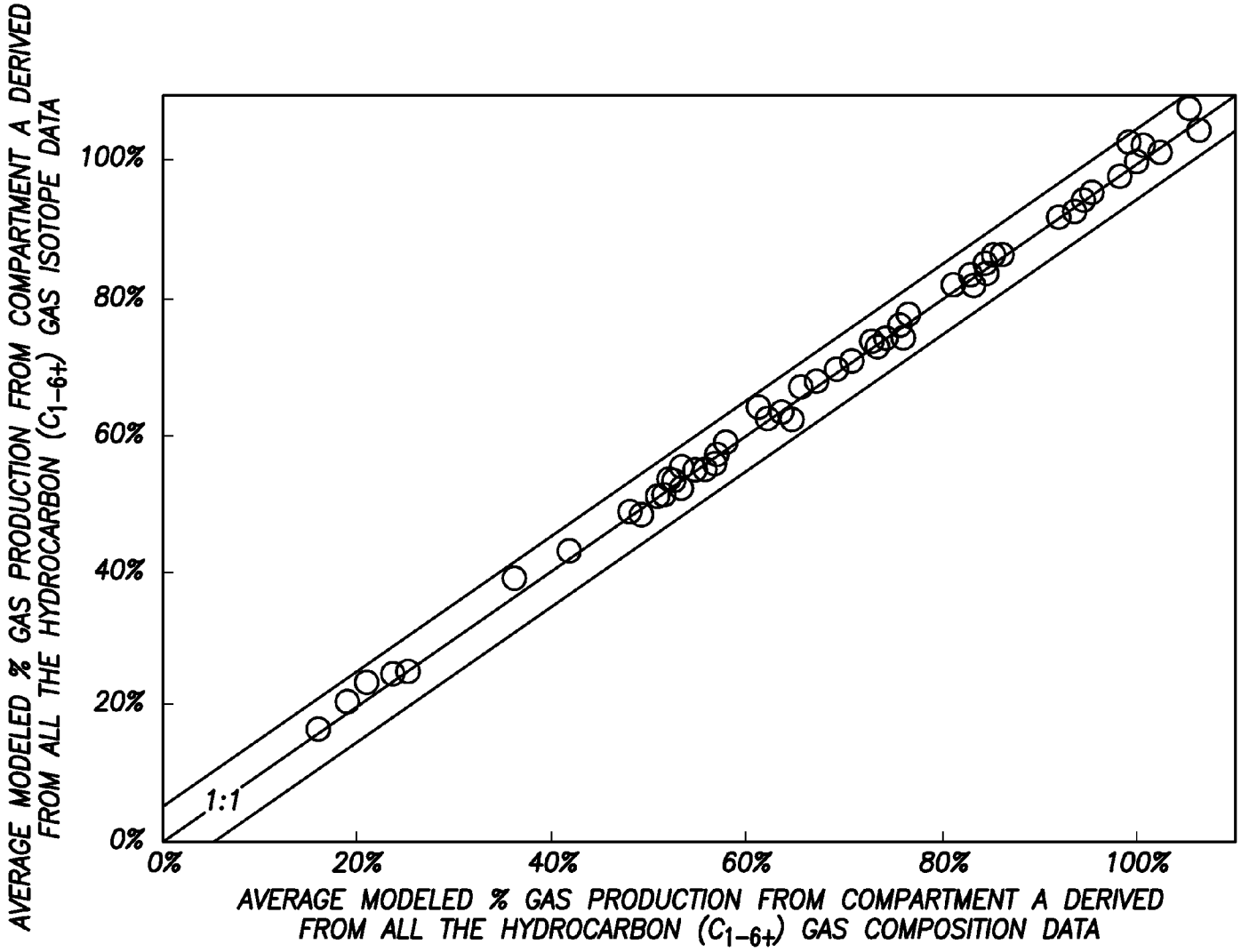
FIG. 8B shows a comparison of composition-based and isotope-based relative contribution data, corresponding to the wells depicted in FIG. 8A.
Figure 9:
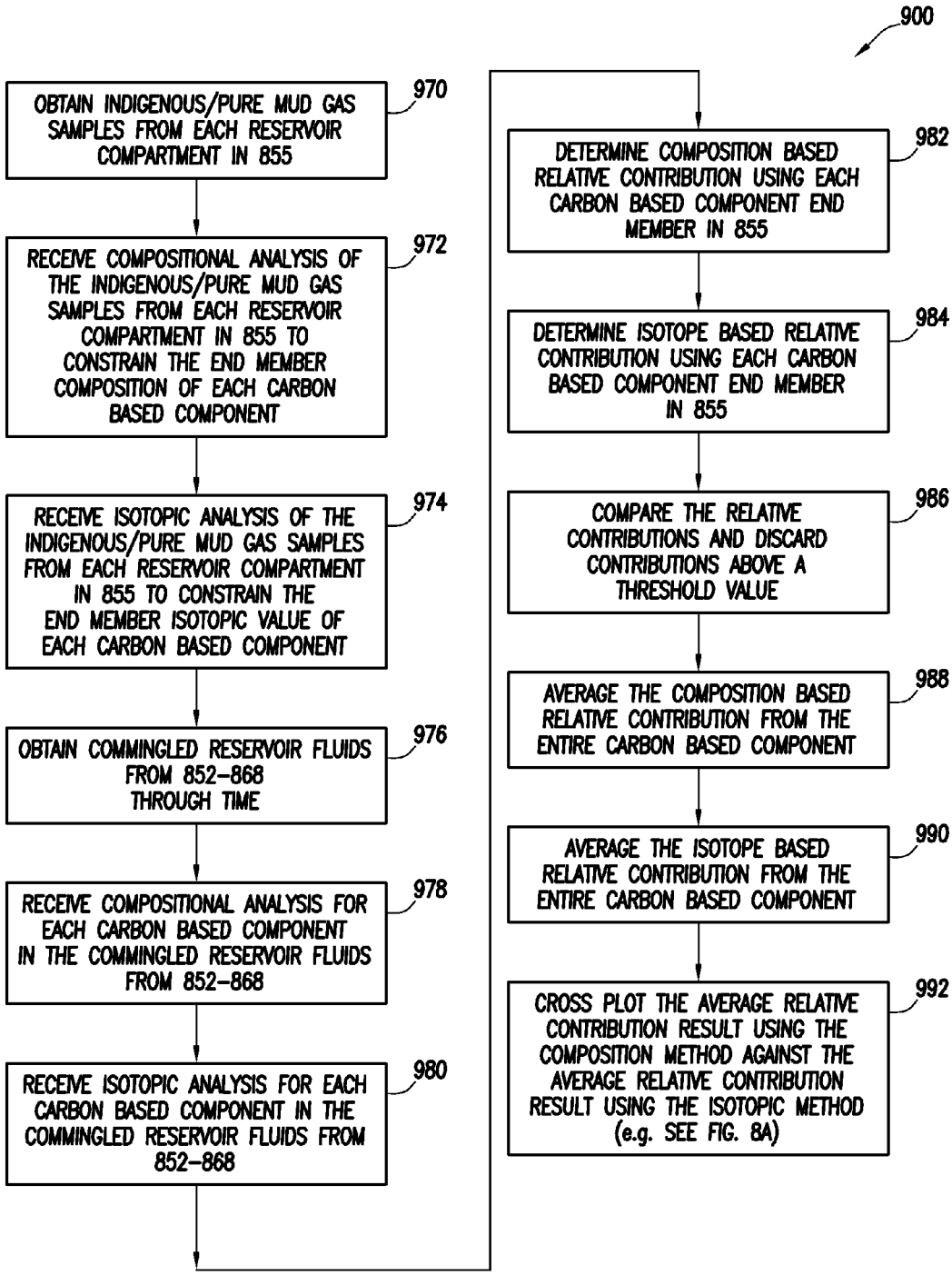
FIG. 9 illustrates the production allocation method used to determine the data depicted in FIG. 8B.

Samples were collected over a 15 month field study and analyzed to for their composition and isotope values. Both average relative composition-based contribution results and average relative isotopic-based contribution results were computed from these samples according to the method depicted in FIG. 9. The results of both methods are shown in Table 1 and depicted in the graph shown in FIG. 8B.

TABLE 1

| well ID | Average Composition Based Allocation % Compartment A gas | Average Isotope Based Allocation % Compartment A gas |
|---|---|---|
| 857 | 36% | 39% |
| 864 | 58% | 58% |
| 862 | 99% | 103% |
| 854 | 106% | 105% |
| 864 | 61% | 64% |
| 867 | 73% | 74% |
| 854 | 100% | 100% |
| 867 | 98% | 98% |
| 852 | 105% | 108% |
| 855 | 100% | 100% |
| 866 | 81% | 82% |
| 863 | 101% | 103% |
| 868 | 103% | 101% |
| 865 | 106% | 105% |
| 856 | 95% | 96% |
| 860 | 85% | 86% |
| 861 | 86% | 86% |
| 854 | 76% | 75% |
| 853 | 106% | 108% |
| 852 | 92% | 92% |
| 868 | 67% | 68% |
| 855 | 100% | 100% |
| 863 | 62% | 62% |
| 854 | 69% | 70% |
| 854 | 66% | 67% |
| 867 | 70% | 71% |
| 859 | 83% | 84% |
| 852 | 94% | 94% |
| 867 | 57% | 55% |
| 867 | 76% | 76% |
| 867 | 84% | 81% |
| 867 | 95% | 95% |
| 867 | 93% | 93% |
| 852 | 53% | 53% |
| 867 | 55% | 55% |
| 861 | 76% | 74% |
| 853 | 48% | 48% |
| 863 | 52% | 51% |
| 865 | 51% | 51% |
| 860 | 84% | 84% |
| 854 | 77% | 78% |
| 867 | 84% | 84% |
| 866 | 71% | 71% |
| 868 | 54% | 55% |
| 859 | 52% | 54% |
| 855 | 95% | 96% |
| 856 | 64% | 63% |
| 858 | 94% | 93% |
| 861 | 56% | 55% |
| 860 | 57% | 57% |
| 858 | 74% | 73% |
| 860 | 21% | 23% |
| 860 | 25% | 25% |
| 867 | 53% | 52% |
| 865 | 56% | 55% |
| 856 | 42% | 43% |
| 868 | 65% | 62% |
| 866 | 16% | 16% |
| 852 | 74% | 74% |
| 859 | 19% | 21% |
| 859 | 24% | 24% |
| 867 | 84% | 83% |
| 867 | 49% | 48% |
| 854 | 63% | 63% |

The data presented relating to study area 851 indicates a good correlation and that these gas geochemistry based production allocation techniques predict average allocation results within a range of ±5% from one other. The ability to constrain potential end member for each carbon components in each reservoir compartment using a single well and apply these end members to possibly older/pre-existing well currently producing co-mingled reservoir fluids over a given area provides significant cost saving measures during production and field development.

Example 2

Figure 10A:
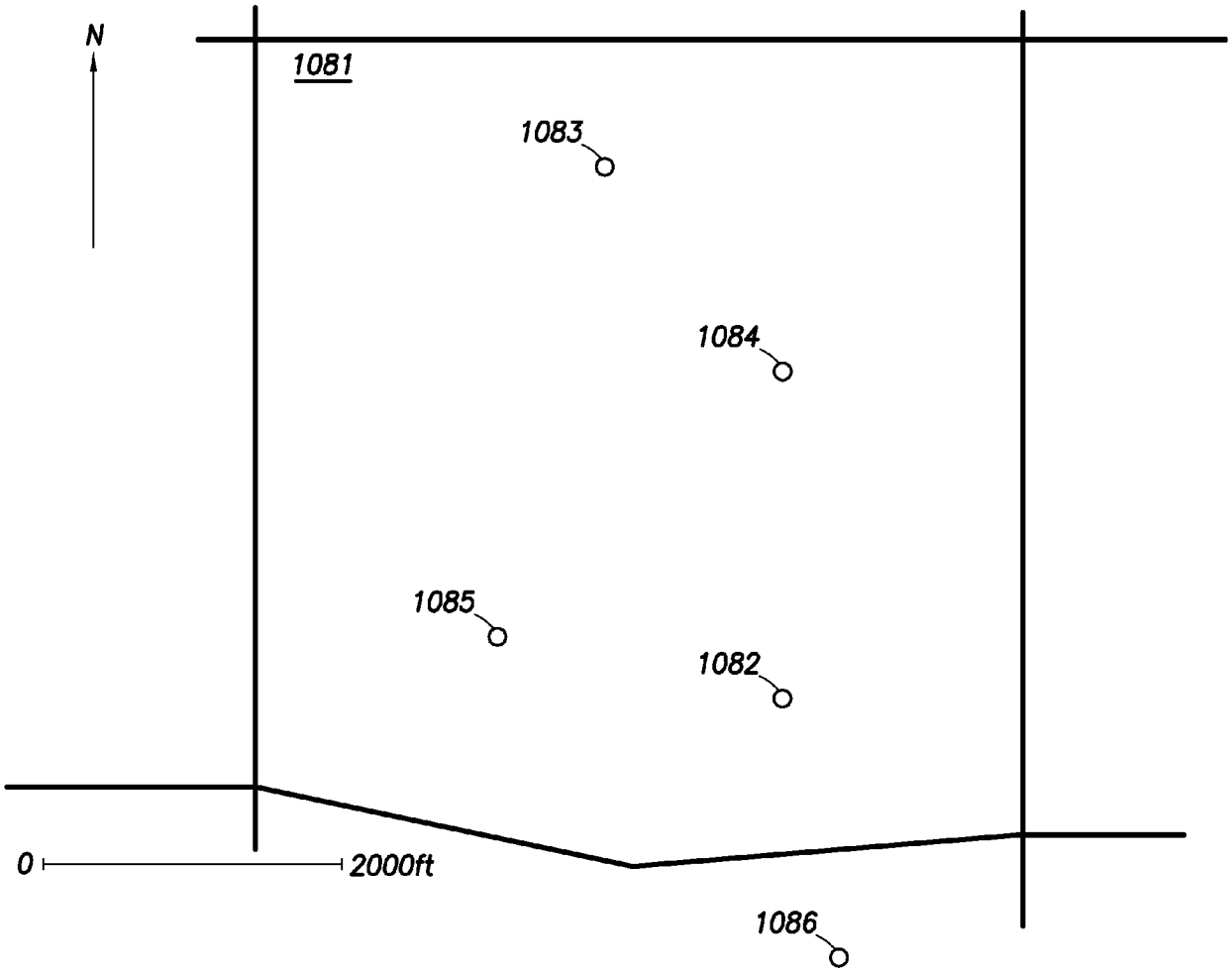
FIG. 10A shows an aerial map of a plurality of wells.

FIG. 10 A shows an aerial map of a plurality of wells sampled over a period of time for validation of the methods herein. Here, one well (1085) with a plurality of compartments is used to constrain the end member composition and isotope values for each compartments and these end members for each carbon components are in turn applied in allocating comingled reservoir fluids from adjacent wells (1082, 1083, 1084 and 1086 where sample 1087 is a repeat sample from well 1086) through time in a given area 1081. FIG. 11 shows the method by which one example of the production allocation methods disclosed herein is validated against other mechanical-based production allocation methods.

Figure 10B:
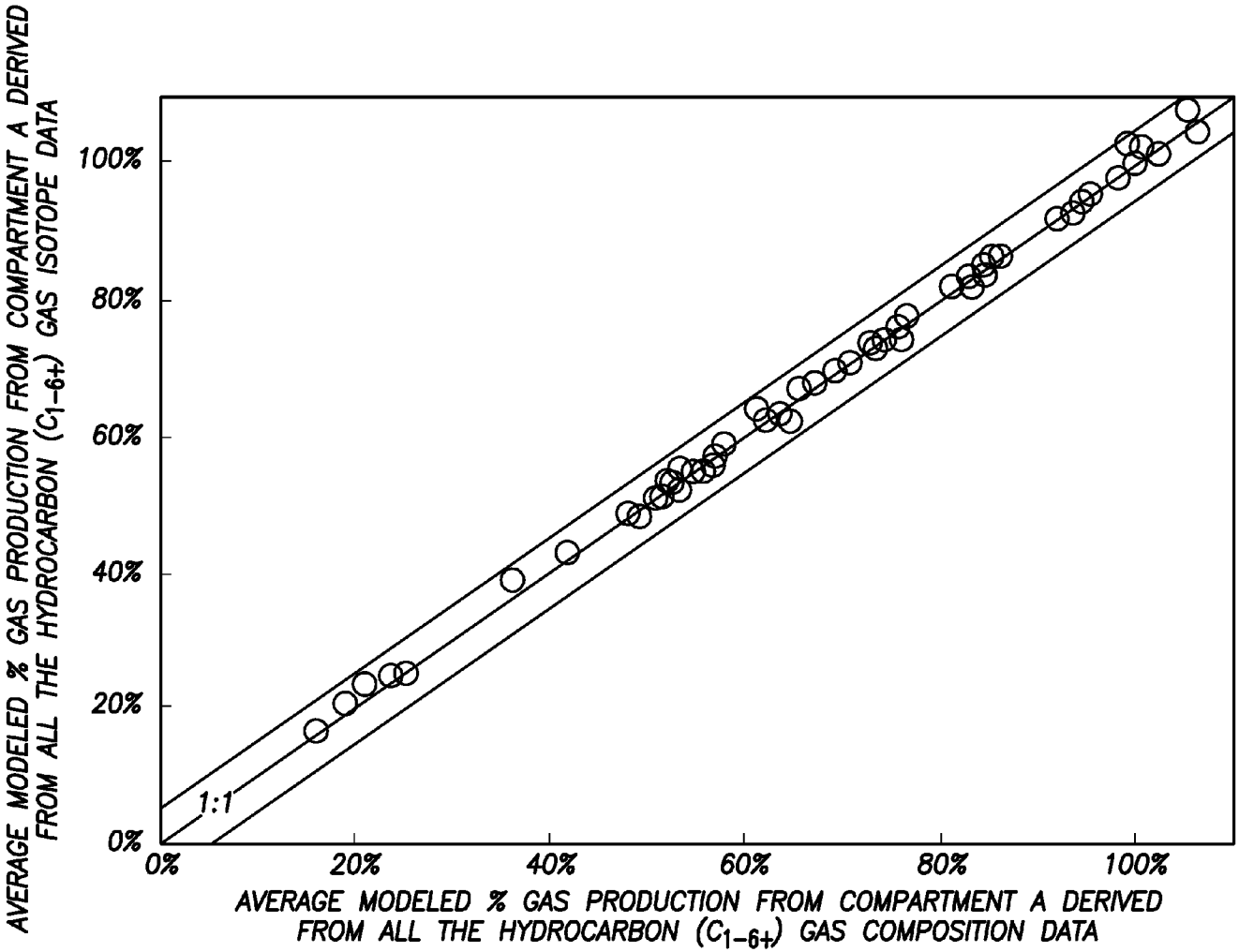
FIG. 10B shows a comparison of production allocation method results to mechanical spinner and decline curve results, corresponding to the wells depicted in FIG. 10A.
Figure 11A:
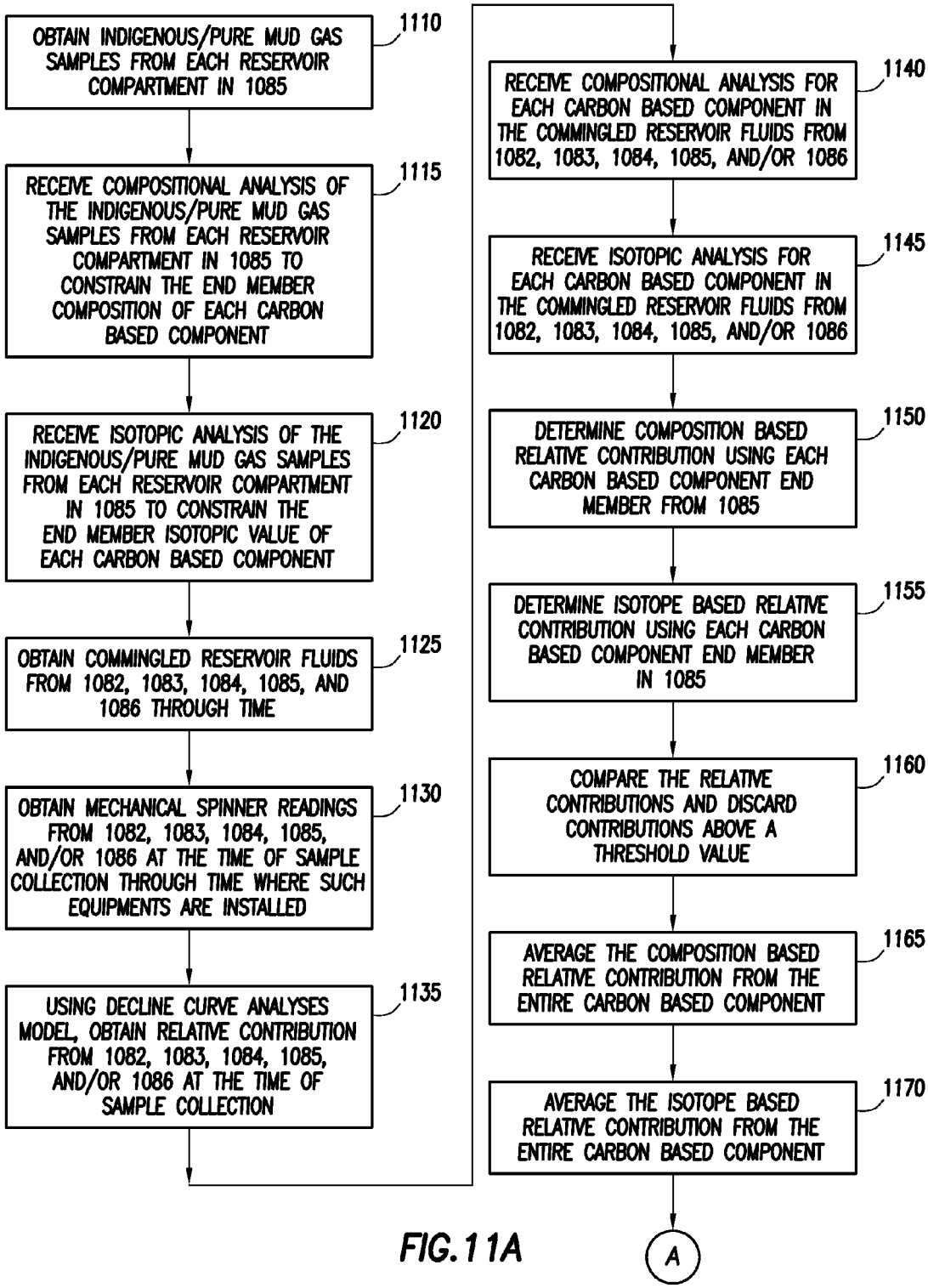
FIGS. 11A and 11B show a method for validating one example of a production allocation method against other mechanical-based production allocation methods.
Figure 11B:
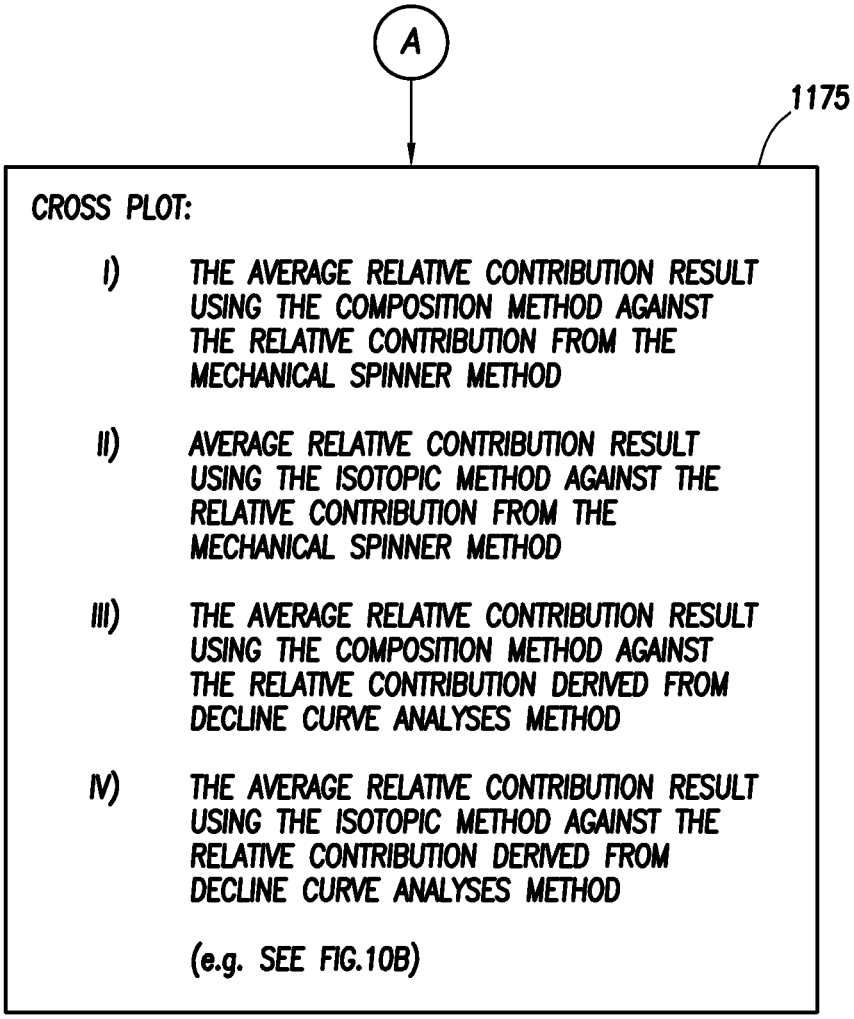

The data relating to study area 1081 computed by this method is shown in FIG. 10B and Table 2.

| Well ID | Average Composition-Based Allocation (% compartment A gas) | Average Isotope Based Allocation (% compartment A gas) | Mechanical Spinner-Based Allocation (% compartment A gas | Decline Curve-Based Allocation (% compartment A gas) |
|---|---|---|---|---|
| 1082 | 36% | 39% | 37% | |
| 1086 | 58% | 58% | 65% | 60% |
| 1085 | 99% | 103% | 100% | |
| 1084 | 106% | 105% | | |
| 1087 | 61% | 64% | 65% | 60% |

This data indicates a good correlation between the average relative contribution result using the composition method and other conventional methods such as the mechanical spinner and decline curve analyses. Similarly, the data presented in this study area 1081 also indicates a good correlation between the average relative contribution result using the isotope method and other conventional methods such as the mechanical spinner and decline curve analyses. FIG. 10B indicates that these gas geochemistry based production allocation techniques could predict average allocation result within a range of ±5% from other more time consuming and very expensive techniques. The ability to constrain potential end member for each carbon components in each reservoir compartment using a single well and apply these end members to possibly older/pre-existing wells currently producing co-mingled reservoir fluids over a given area provides significant cost saving measures during production and field development. In addition, the field demonstration of the very good correlation between allocation results from these gas geochemistry techniques and other more conventional approaches validate the potential for gas geochemistry as a replacement methodology for production allocation in producing gas fields with a plurality of compartments.

It is explicitly recognized that any of the elements and features of each of the devices described herein are capable of use with any of the other devices described herein with no limitation. Furthermore, it is explicitly recognized that the steps of the methods herein may be performed in any order except unless explicitly stated otherwise or inherently required otherwise by the particular method.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations and equivalents are considered within the scope and spirit of the present invention.

What is claimed is:

1. An allocation method for allocating production among a plurality of reservoir compartments in a subterranean formation, the allocation method comprising the steps of:

(a) obtaining a compartment sample from each of the reservoir compartments, each reservoir compartment having a reservoir fluid, wherein each reservoir fluid is characterized by a plurality of components, wherein the plurality of components comprises a plurality of carbon-based components, wherein each carbon-based component of each reservoir compartment comprises a plurality of stable carbon isotopes;

(b) analyzing each of the compartment samples to determine a composition fraction of one or more of the carbon-based components of each reservoir compartment;

(c) analyzing each of the compartment samples to determine a stable carbon isotope value of the one or more of the carbon-based components of each reservoir compartment;

(d) allowing a fluid to flow from each reservoir compartment and commingle to produce a commingled output production stream, the commingled production stream comprised of a relative contribution from each reservoir compartment;

(e) analyzing the commingled production stream to determine an output composition of each of the one or more carbon-based components of the commingled output production stream;

(f) analyzing the commingled production stream to determine an output stable carbon isotope value of each of the one or more carbon-based components of the commingled output production stream;

(g) determining a composition-based relative contribution of fluid from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream; and (h) determining an isotope-based relative contribution of fluid from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream.

2. The method of claim 1:

wherein the composition-based relative contribution may be determined based on the output composition of the commingled production stream and the composition fraction of each of the one or more carbon-based components in each reservoir compartment; and wherein the isotope-based relative contribution may be determined based on the output stable carbon isotope values of the commingled production stream and the stable carbon isotope value of each of the one or more carbon-based components in each reservoir compartment.

3. The method of claim 2:

wherein the composition fractions are normalized composition fractions and wherein the output compositions are normalized output compositions, by excluding one or more components of non-interest, and wherein the stable carbon isotope values and normalized stable carbon isotope values and wherein the output stable carbon isotope values are normalized output stable carbon isotope values, by excluding one or more components of non-interest.

4. The method of claim 2 further comprising the steps of:

comparing the isotope-based relative contribution to the composition-based relative contribution to produce a comparison between the isotope-based relative contribution and the composition-based relative contribution; and discarding the comparison if the comparison is above a tolerance threshold level.

5. The method of claim 4 wherein the comparison is a percentage of the isotope-based relative contribution as compared to the composition-based relative contribution.

6. The method of claim 5 wherein the tolerance threshold level is between about 2 percent and about 20 percent.

7. The method of claim 5 wherein the tolerance threshold level is less than about 15 percent.

8. The method of claim 4 further comprising the step of adjusting the relative contribution from one of the reservoir compartments based on one of the composition-based relative contribution and the isotope-based relative contribution.

9. The method of claim 8 further comprising the step of decreasing or ceasing production from one of the reservoir compartments when one of the composition-based relative contribution and the isotope-based relative contribution is less than a threshold production level.

10. The method of claim 4 further comprising the step of outputting one of the composition-based relative contribution and the isotope-based relative contribution to a user.

11. The method of claim 1 wherein the first mass balance system of equations is characterized by $$\sum_{j=1}^{a}\sum_{i=1}^{b} C_{i,j}\cdot(x) = C_{i,mix} \text{ and } \sum_{j=1}^{a} x = 1,$$

wherein the variable "a" refers to the total number of reservoir compartments, wherein the variable "b" refers to the total number of carbon-based components, wherein $C_{i,j}$ refers to the mole fraction or volume fraction of component i in reservoir compartment j, wherein the variables x refers to the volume fraction contribution of fluid volume from each reservoir compartment j.

12. The method of claim 1 wherein the second mass balance system of equations is characterized by $$\sum_{j=1}^{a}\sum_{i=1}^{b} (\delta C_{i,j})(C_{i,j})\cdot(x) = (\delta C_{i,mix})(C_{i,mix}) \text{ and } \sum_{j=1}^{a} x = 1,$$

wherein the variable "a" refers to the total number of reservoir compartments, wherein the variable "b" refers to the total number of carbon-based components, wherein $\delta C_{i,j}$ refers to the stable carbon isotope value of component i in reservoir compartment j, wherein $C_{i,j}$ refers to the mole fraction or volume fraction of component i in reservoir compartment j, and wherein x refers to the volume fraction contribution of fluid volume from each reservoir compartment j.

13. The method of claim 12 further comprising the step of repeating steps (e)-(h) at a plurality of time intervals.

14. The method of claim 1 wherein the analyzing of step (b) is accomplished at least in part by gas chromatography and wherein the analyzing of step (c) is accomplished at least in part by mass spectroscopy.

15. The method of claim 1 wherein the reservoir fluid is a gas.

16. The method of claim 5 further comprising the steps of:

repeating steps (e)-(h) at a plurality of time intervals;

wherein the first mass balance system of equations is characterized by $$\sum_{j=1}^{a}\sum_{i=1}^{b} C_{i,j}\cdot(x) = C_{i,mix} \text{ and } \sum_{j=1}^{a} x = 1,$$

wherein the variable "a" refers to the total number of reservoir compartments, wherein the variable "b" refers to the total number of carbon-based components, wherein $C_{i,j}$ refers to the mole fraction or volume fraction of component i in reservoir compartment j, wherein the variables x refers to the volume fraction contribution of fluid volume from each reservoir compartment j;

wherein the second mass balance system of equations is characterized by $$\sum_{j=1}^{a}\sum_{i=1}^{b} (\delta C_{i,j})(C_{i,j})\cdot(x) = (\delta C_{i,mix})(C_{i,mix}) \text{ and } \sum_{j=1}^{a} x = 1,$$

wherein the variable "a" refers to the total number of reservoir compartments, wherein the variable "b" refers to the total number of carbon-based components, wherein $\delta C_{i,j}$ refers to the stable carbon isotope value of component i in reservoir compartment j, wherein $C_{i,j}$ refers to the mole fraction or volume fraction of component i in reservoir compartment j, and wherein x refers to the volume fraction contribution of fluid volume from each reservoir compartment j;

wherein the analyzing of step (b) is accomplished at least in part by gas chromatography and wherein the analyzing of step (c) is accomplished at least in part by mass spectroscopy; and wherein the reservoir fluid is a gas.

17. An evaluation method for assessing the effectiveness of an intervention operation in a subterranean formation having a plurality of reservoir compartments, each reservoir compartment having a reservoir fluid, wherein each reservoir fluid is characterized by a plurality of components, wherein the plurality of components comprises a plurality of carbon-based components, wherein each carbon-based component of each reservoir compartment comprises a plurality of stable carbon isotopes, wherein the evaluation method comprises the steps of:

(a) analyzing each of the compartment samples to determine a composition fraction of one or more of the carbon-based components of each reservoir compartment;

(b) analyzing each of the compartment samples to determine a stable carbon isotope value of the one or more of the carbon-based components of each reservoir compartment;

(c) allowing fluid to flow from each reservoir compartment and commingle to produce a commingled output production stream, the commingled production stream comprised of a relative contribution from each reservoir compartment;

(d) analyzing the commingled production stream to determine an output composition of each of the one or more carbon-based components of the commingled output production stream;

(e) analyzing the commingled production stream to determine an output stable carbon isotope value of each of the one or more carbon-based components of the commingled output production stream;

(f) determining a first composition-based relative contribution of each fluid from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream;

(g) determining a first isotope-based relative contribution of fluid from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream;

(h) performing the intervention operation in the subterranean formation, the intervention operation having an effect on the relative contribution from each reservoir compartment;

(i) after step (h), determining a second composition-based relative contribution of each fluid from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream;

(j) after step (h), determining a second isotope-based relative contribution of fluid from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream.

(k) comparing one of (A) the second composition-based relative contribution and (B) the second isotope-based relative contribution to one of ($\alpha$) the first composition-based relative contribution and ($\beta$) the first isotope-based relative contribution to determine an effectiveness of the intervention operation.

18. The method of claim 17 wherein the intervention operation is a treatment operation or a secondary operation, wherein the treatment operation is stimulation and wherein the secondary operation is a steam flooding operation.

19. The method of claim 18 wherein stimulation is an acid matrix stimulation operation or a fracturing stimulation operation.

20. An evaluation method for evaluating an effectiveness of applying an allocation method from a first wellbore to a second wellbore wherein the first wellbore is disposed in a subterranean formation having a plurality of reservoir compartments, each reservoir compartment having a reservoir gas, wherein each reservoir gas is characterized by a plurality of components, each component having a stable carbon isotope value, wherein the evaluation method comprises the steps of:

(a) receiving a composition fraction of one or more of the carbon-based components of each reservoir compartment;

(b) receiving a stable carbon isotope value of the one or more of the carbon-based components of each reservoir compartment;

(c) allowing a second commingled production stream to flow from the second wellbore, the second commingled production stream having a plurality of carbon-based components and a plurality of stable carbon isotopes;

(d) receiving an output composition of one or more carbon-based components of the second commingled output production stream;

(e) receiving a stable carbon isotope value of one or more stable carbon isotopes of the second commingled output production stream;

(f) determining a composition-based relative contribution of gas from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream; and (g) determining an isotope-based relative contribution of gas from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream.

21. An allocation method for allocating production among a plurality of reservoir compartments in a subterranean formation, each reservoir compartment having a reservoir gas, wherein each reservoir gas is characterized by a plurality of components, each component having a stable carbon isotope value, wherein the evaluation method comprises the steps of:

(a) receiving a composition fraction of one or more of the carbon-based components of each reservoir compartment;

(b) receiving a stable carbon isotope value of the one or more of the carbon-based components of each reservoir compartment;

(c) allowing a gas to flow from each reservoir compartment and commingle to produce a commingled output production stream, the commingled production stream comprised of a relative contribution from each reservoir compartment;

(d) receiving an output composition of each of the one or more carbon-based components of the commingled output production stream;

(e) receiving a stable carbon isotope value of each of the one or more carbon-based components of the commingled output production stream;

(f) determining a composition-based relative contribution of gas from each reservoir compartment by solving a first mass balance system of equations for each of the one or more carbon-based components, wherein the first mass balance system of equations is characterized by a first mass balance of each of the one or more carbon-based components from each reservoir compartment mixing to produce the commingled output production stream; and (g) determining an isotope-based relative contribution of gas from each reservoir compartment by solving a second mass balance system of equations for each of the one or more stable carbon isotopes, wherein the second mass balance system of equations is characterized by a second mass balance of each of the one or more stable carbon isotopes from each reservoir compartment mixing to produce the commingled output production stream.

* * * * *